US006339444B1

(12) United States Patent
Sugiyama

(10) Patent No.: US 6,339,444 B1
(45) Date of Patent: Jan. 15, 2002

(54) THERMAL HEAT AND THERMAL PRINTER

(75) Inventor: Hayami Sugiyama, Ise (JP)

(73) Assignee: Shinko Electric Co., Ltd., Tokyo (JP)

( * ) Notice: Subject to any disclaimer, the term of this patent is extended or adjusted under 35 U.S.C. 154(b) by 0 days.

(21) Appl. No.: 09/700,063

(22) PCT Filed: May 8, 1998

(86) PCT No.: PCT/JP98/02043

§ 371 Date: Nov. 8, 2000

§ 102(e) Date: Nov. 8, 2000

(87) PCT Pub. No.: WO99/58340

PCT Pub. Date: Nov. 18, 1999

(51) Int. Cl.[7] ..... B41J 2/335; B41J 2/325
(52) U.S. Cl. ..... 347/200; 347/175; 347/205
(58) Field of Search ..... 347/200, 205, 347/175, 185, 187, 194, 195

(56) References Cited

U.S. PATENT DOCUMENTS

| | | | |
|---|---|---|---|
| 4,539,571 | A | 9/1985 | Suzuki |
| 4,947,188 | A | 8/1990 | Nozaki |
| 4,978,972 | A | 12/1990 | Volpe, Jr. et al. |
| 5,376,952 | A | 12/1994 | Kokubo et al. |

FOREIGN PATENT DOCUMENTS

| | | | |
|---|---|---|---|
| JP | 56-118879 | | 9/1981 |
| JP | 57-116664 | | 7/1982 |
| JP | 60-97869 | | 5/1985 |
| JP | 60-110467 | | 6/1985 |
| JP | 61-31269 | | 2/1986 |
| JP | 61-53056 | | 3/1986 |
| JP | 61-112664 | | 5/1986 |
| JP | 61-274961 | | 12/1986 |
| JP | 63-116874 | | 5/1988 |
| JP | 63-267571 | | 11/1988 |
| JP | 2-184168 | | 7/1990 |
| JP | 2-215550 | | 8/1990 |
| JP | 2-262 | | 1/1991 |
| JP | 3-2052 | | 1/1991 |
| JP | 3-143642 | | 6/1991 |
| JP | 4-103361 | | 4/1992 |
| JP | 4-220360 | * | 8/1992 |
| JP | 4-232764 | | 8/1992 |
| JP | 4-320854 | | 11/1992 |
| JP | 5-169709 | | 7/1993 |
| JP | 5-261953 | | 10/1993 |
| JP | 5-330110 | | 12/1993 |
| JP | 5-338233 | | 12/1993 |
| JP | 7-101094 | | 4/1995 |
| JP | 7-125289 | | 5/1995 |

* cited by examiner

*Primary Examiner*—Huan Tran
(74) *Attorney, Agent, or Firm*—Scully, Scott, Murphy & Presser

(57) ABSTRACT

A thermal head of the present invention comprises a substrate (1221) consisting of a metal such as a stainless steel, insulating layers (1226, 1223), with raised portions (1225, 1224) being formed by raising up a part of the surface thereof, and exothermic resistors (1228, 1229) formed on the raised portions. Common electrodes (1222, 1227) are disposed on the substrate, which protrude from the surface of the substrate, penetrate through the raised portions and are connected to the exothermic resistors, to thereby divide the resistors into first exothermic resistors and second exothermic resistors, centering on the connecting point.

14 Claims, 23 Drawing Sheets

Y COLOR PRINT

C COLOR PRINT

THERMAL HEAT AND THERMAL PRINTER

TECHNICAL FIELD

The present invention relates to a thermal head suitable for color printers or the like, a substrate used in the thermal head, and an image recording method.

BACKGROUND ART

A structure of a single-line thermal head comprising a plurality of exothermic resistors formed in a line will be described, with reference to FIG. 1 and FIG. 2. FIG. 1 is a perspective view of a single-line type thermal head, and FIG. 2 is a sectional view of the thermal head, taken along the line A–A' in FIG. 1. In these figures, reference symbol 101 denotes an alumina substrate, and on the upper face of this substrate 101, there are formed respective parts of the thermal head, and on the bottom face thereof is adhered a radiation fin 102. The radiation fin 102 is for efficiently radiating heat generated in each part in the operation of the thermal head, into the air.

Reference symbol 103 denotes exothermic resistors, which generate heat when an electrical current is made to flow between a common electrode 104 and individual lead electrodes 105. The common electrode 104 is an electrode common to all exothermic resistors 103, and is connected respectively to contact portions 106 of each exothermic resistor 103. The individual lead electrodes 105 are connected to each contact portion 107 of each exothermic resistor 103, and wired respectively to each terminal 109 of an IC (Integrated Circuit) 108.

Reference symbol 110 denotes a glaze, formed in a half spindle shape on the upper face of the alumina substrate 101, and functions as a heat reservoir for storing heat energy generated by the exothermic resistor 103 at the time of printing processing. Reference symbol 111 denotes a flexible printed circuit board for connection, and a wiring for connecting with a controller of a printer body (not shown) is formed thereon. Reference symbol 112 denotes a protection layer, for protecting the exothermic resistor 103 and electrodes 104, 105 from wear due to contact with the paper at the time of printing.

A production method of the thermal head in FIG. 1 will now be described. At first, in order to remove dust on the surface of the alumina substrate 101, the alumina substrate 101 is cleaned. After cleaning, a thin film of the exothermic resistors 103 is formed by sputtering using a sputtering system, on the upper face of the alumina substrate 101, so that the exothermic resistor film has a predetermined sheet resistance. An electrode material (for example, aluminum) is then formed on the upper face of the thin film material of the exothermic resistors 103 by sputtering or a vapor deposition method.

A photoresist is then coated on the electrode material film, to thereby prepare a resist pattern of the common electrode 104 and the individual lead electrodes 105 by photolithography. The electrode material is etched using this photoresist pattern as a mask, to form the common electrode 104 and the individual lead electrodes 105. The whole resist is then removed, and a new resist is coated on the thin film material of the exothermic resistors 103, the common electrode 104 and the individual lead electrodes 105.

Then, a resist pattern for forming the exothermic resistors 103 for each printing dot is formed by photolithography. A thin film consisting of the exothermic resistors 103 is divided into exothermic resistors 103 for each dot by etching. A protection film 112 is then formed on the upper part of the glaze 110 by sputtering, using a mask for forming the protection film. Then, the protection film 112 is subjected to a heat treatment, for realizing stabilization of a resistance value of the exothermic resistors and stabilization of intimate contact between the exothermic resistors and the electrode material.

An insulating film is formed in the IC mounting area, and an IC 108 is subjected to die bonding on this IC mounting area Terminals of the IC 108 and wire-bond terminals 109 of the individual lead electrodes 105 are connected by wire bonding, and seal the IC 108, the wire bond portion and a part of the individual lead electrode 105 are sealed by a resin. A single-line thermal head is produced by the above-described production process.

As a second conventional example, there is shown a thermal head in FIG. 3 and FIG. 4 (see Japanese Patent Application No. 62-217627). FIG. 3 is a plan view of a double-line thermal head where a plurality of exothermic resistors are arranged in two lines in parallel, and FIG. 4 is a sectional view, taken along the line B–B' in FIG. 3. As shown in these figures, a first alumina substrate 301 and a second alumina substrate 302 are connected with a metal plate 314 placed therebetween. The metal plate 314 is a common electrode and connected with other common electrode 313.

Reference symbol 305 denotes a first exothermic resistor, and is connected to a first individual lead electrode 306 via a contact area 307, and is connected to a common electrode 313 via a contact area 312. A second exothermic resistor 309 is connected to a second individual lead electrode 315 via a contact area 316, and is connected to a common electrode 313 via a contact area 310. Reference symbol 311 denotes a protection layer, which protects the exothermic resistors 305 and 309 from wear due to contact with a sheet of paper to be printed.

As a conventional third example, there is a double-line thermal head having a section shown in FIG. 5. In this figure, a wiring groove 318 is formed in an alumina substrate 300, and a common electrode 317 is formed therein by embedding a bulk metal into the wiring groove 318. A common electrode 313 is formed on the wiring groove 318, and connected to the common electrode 317.

The operation of the thermal head shown in FIG. 1 will now be described with reference to FIG. 6. FIG. 6 shows an equivalent circuit of the thermal head, wherein reference symbol 120 denotes a power source, which supplies drive power for the thermal head. Reference symbol 103 denotes an exothermic resistor, 104 denotes a common electrode, 105 denotes an individual lead electrode, and 108 denotes a control IC.

At first, a data signal DATA corresponding to each exothermic resistor 103 is input at to the control IC 108, synchronized with a clock signal CLK having a constant period transmitted from a printer body (not shown), and information of the data signal DATA is stored in a storage section inside the control IC 108, upon "build up" of a latch signal LATCH. Based on the stored information, for example, when a strobe signal STB is "1", the exothermic resistors 103 are energized to generate heat energy. Here, at the time of printing, printing information of the next line is transferred from the printer body synchronized with the clock signal CLK, by means of the data signal DATA. The control IC controls ON/OFF of the exothermic resistors 103 based on the data supplied from this control section. The thermal head substrate is secured to a heat sink 102 by means of double sided adhesive tape, adhesive or the like.

On the other hand, a heat sensitive paper made to develop color by the thermal head has a construction shown in FIG. 7. This heat sensitive paper has such a construction that a cyan recording layer 712, a magenta recording layer 713 and a yellow recording layer 714 are sequentially laminated on a base material 711 such as paper, and the surface is covered with a heat-resistant protection layer 715. The cyan recording layer 712 has a structure such that microcapsules 717 are dispersed in the cyan developer 716, and a cyan leuco dye 718 which reacts with the cyan developer 716 and makes it develop color is sealed in these microcapsules 717.

The magenta recording layer 713 has a structure such that microcapsules 720 are dispersed in the magenta recording layer 713 mainly composed of a coupler 719, and a magenta diazo dye 721 which reacts with the coupler 719 and develops magenta color is sealed in these microcapsules 720.

Moreover, the yellow recording layer 714 has a structure such that microcapsules 723 are dispersed in a yellow coupling agent 722, and a yellow diazo dye 724 which reacts with the yellow coupling agent 722 and develops color is sealed in these yellow microcapsules 723.

FIG. 8 shows one example of a conventional printer constructed in this manner and using a full color heat sensitive paper. Reference symbol 830 denotes a paper cassette, and in this paper cassette 830, heat sensitive papers 831 having the above-described construction are stacked. Above the heat sensitive paper 831 in the stacked condition, there is provided a feed roller 832 which is brought into contact with the upper face of the heat sensitive paper to exert a frictional force thereon in the direction of the page (in the rightward direction in FIG. 8), and a paper guide 833 is provided in the feed direction of the feed roller 832, to guide the heat sensitive paper upwards. Above the paper cassette 830, there is provided a belt 838 wound around rollers 834, 835, 836 and 837. Of these rollers 834 to 837, the roller 836 clamps and holds the heat sensitive paper with a roller 839, and feeds the heat sensitive paper in the direction of the arrow in the figure at a predetermined timing. The roller 837 is a platen roller and is disposed opposite to the thermal head 870.

On the periphery of the belt 838, there is provided a damper 839A for clamping the heat sensitive paper 831 fed out from the paper cassette 830, and the heat sensitive paper 831 is clamped and held by this damper 839A.

At a position on the downstream side of the thermal head 870, there are provided a Y lamp 840 and an M lamp 841 respectively for irradiating beams of light having a predetermined wavelength onto the surface of the heat sensitive paper 831. The operation of these lamps 840 and 841 will be described later. At a position on the further downstream side of the lamps 840, 841, a pair of paper ejection rollers 842, 843 are disposed in the vicinity of the, roller 834, so that the tip of the heat sensitive paper which tends to move in the tangent direction away from the belt 838 bent around the roller 834 is clamped and held therebetween and ejected. On the outer periphery of the other paper ejection roller 842 is disposed a paper guide 844, which guides the printed heat sensitive paper fed out from the roller 842 in a predetermined paper ejection direction.

The principle of color printing in the printer having the above-described construction will be described using FIGS. 7 to 10. The heat sensitive paper 831 whose tip is clamped and held by the damper 839A of the belt 838 is fed to the platen roller 837. At a timing when the tip of the heat sensitive paper 831 passes the platen roller 837, the thermal head 870 is pressed onto the heat sensitive paper 831, and processing comprising the following steps (a) to (e) is executed.

(a) As shown in FIG. 9A, when the yellow recording layer 714 is heated, the yellow capsule 723 therein is softened due to the heat, and the yellow coupling agent 722 penetrates into the yellow capsule 723 to thereby react with the yellow diazo dye 724 and develop color (shaded portion in the yellow recording layer 714 in FIG. 9A). The transmission quantity of the yellow coupling agent 722 is proportional to the energy quantity applied onto the heat sensitive paper 831 from the thermal head 870, as shown in FIG. 10, and color is developed in yellow concentration due to the property shown in FIG. 10, depending on the applied energy. Since the magenta capsule 720 and the cyan microcapsule 717 are set to have a higher softening temperature than that of the yellow microcapsule 723, the magenta recording layer 713 and the cyan recording layer 712 do not develop color.

(b) When the tip of the heat sensitive paper 831 reaches the position of the yellow fixing lamp (Y lamp) 840, as shown in FIG. 9B, the yellow fixing lamp 840 is lighted, to thereby decompose the undeveloped yellow dye by the light.

(c) As shown in FIG. 9C, the belt 838 is made to go around to feed the heat sensitive paper 831 again to the thermal head 870, to develop magenta color. Specifically, the magenta microcapsule 720 is softened by heat, and the magenta diazo dye 721 therein is reacted with the magenta coupling agent 719 to develop color (shaded portion in the magenta recording layer 713). The softening temperature of the cyan microcapsule 717 is set higher than that of the magenta microcapsule 720, and hence the cyan recording layer does not develop color. With regard to the transmission quantity of the magenta coupling agent 719, color is developed in a concentration proportional to the energy quantity applied onto the heat sensitive paper 831 from the thermal head 870, as with the case of yellow.

(d) As shown in FIG. 9D, when the tip of the heat sensitive paper 831 reaches the position of the magenta fixing lamp (M lamp) 841, the magenta fixing lamp 841 is lighted, to thereby decompose the undeveloped magenta dye by the light to lose the color development capability. The magenta fixing lamp 841 decomposes the magenta dye with beams of light having a peak at a wavelength of 365 nm.

(e) As shown in FIG. 9E, the belt 838 is made to go around to feed the heat sensitive paper 831 again to the thermal head 870, to develop cyan color. Specifically, the cyan microcapsule 717 is softened by heat, and the cyan leuco dye 718 therein is reacted with the cyan developer 716 to develop color (hatched portion in FIG. 9E).

When full color printing is completed by the cyan color development in the above step (e), the tip of the heat sensitive paper 831 is removed from the damper 839, and fed to between the paper ejection rollers 842 and 843, to thereby be ejected along the guide plate 844. According to need, the belt 838 may be further made to go around, to thereby perform bleach processing of the non-developed portion by the yellow fixing lamp 840 and the magenta fixing lamp 841.

On the other hand, if the double-line thermal head shown in FIG. 3 is used, two lines can be printed simultaneously, and hence the printing time can be reduced to half, in principle.

However, with the thermal head shown in FIGS. 3 to 5, since the coefficient of thermal expansion of the common electrode using a bulk metal and the alumina substrate is different, peeling easily occurs on the connection interface thereof. If peeling occurs between the alumina substrate and the bulk metal, thermal stress is applied to the thin film electrode formed on the common electrode, and since the mechanical strength of the thin film is low, the thin film suffers damage. As a result, there is a disadvantage in that implementation is difficult. A first object of the present invention is to provide a double-line thermal head which is practical and capable of high-speed printing.

On the other hand, the present inventors have proposed to utilize a double-line thermal head and use exothermic resistors in one line for preheating for applying bias energy. In this case, it is not necessary to control ON/OFF of the exothermic resistor for each unit of printing dot. That is to say, it is not necessary to connect each heating element individually to the control IC, and these may be ON/OFF controlled collectively, or put together in two or more blocks. A second object of the present invention is to provide a thermal head which can be produced at a low production cost, has a preheating function and is capable of high-speed printing.

Speed-up of the printing speed is also possible by a printing method using a plurality of thermal heads, other than by improving the thermal head. FIG. 11 shows a structure of a high-speed printer using three thermal heads, wherein on a color heat sensitive paper 1102 drawn out from a paper cassette 1101, yellow is developed by a yellow thermal head 1111Y, and undeveloped yellow dye is decomposed by a yellow fixing lamp 1121Y, then magenta is developed by a magenta thermal head 1111M, and undeveloped magenta dye is decomposed by a magenta fixing lamp 1121M, and further cyan is developed by a cyan thermal head 1111C, and undeveloped cyan dye is decomposed by a cyan fixing lamp 1121C. Thermal heads 1111Y-C are the same as those shown in FIG. 1 or FIG. 3.

According to this apparatus, since there are raised portions due to the thickness of the IC, as shown in the figure, on the thermal head substrate faces 1112Y-C, guide rollers are used to bend a path line for the sheet in a complicated shape, in order to avoid these raised portions. Accordingly, there is a disadvantage in that not only the mechanism is complicated, but also maintenance of positioning precision in each thermal head becomes difficult, and hence deviation in the printing dot easily occurs. A third object of the present invention is to provide a thermal head in which the path line for the sheet can be constructed straight.

In the energizing pulse length (energy) required for development of each color, there is the relationship as shown in FIG. 10.

pulse length of yellow<pulse length of magenta<pulse length of cyan

The marginal energy immediately before each color Y, M, C is developed is assumed to be bias energy $P_{BY}$, $P_{BM}$ and $P_{BC}$, as shown in FIG. 10. On the other hand, the energy required for representing a predetermined gradation for each color is denoted by $P_{GY}$, $P_{GM}$ and $P_{GC}$ in FIG. 10 and at the time of actual development of color, pulses corresponding to $P_{BY}+P_{GY}$, $P_{BM}+P_{GM}$, and $P_{BC}+P_{GC}$ are supplied to the thermal head 870.

Generally, physical properties are adjusted so that the maximum value of $P_{GY}$, $P_{GM}$ and $P_{GC}$ in the heat sensitive paper 831 becomes substantially the same value.

$$P_{GY} \approx P_{GM} \approx P_{GC} \approx P_G \qquad \text{Expression (1)}$$

(wherein $P_G$=pulse length corresponding to the maximum gradation)

Also, in the case of a direct thermosensitive method, as is obvious from FIG. 10, the following relationship is established between each pulse:

$$P_{BM} \approx P_{BY}+P_G P_{BC} \approx P_{BM}+P_G \approx P_{BY}+2P_G \qquad \text{Expression (2)}$$

Moreover, the net printing time $P_T$ is calculated by the following expression:

$$P_T=\{(P_{BY}+P_G)+(P_{BM}+P_G)+(P_{BC}+P_G)\}\times\text{number of lines} \qquad \text{Expression (3)}$$

wherein $P_T$ is the net time required for printing three colors, and in the actual printing, a longer time than $P_T$ is required since paper taking-in and ejection time is included.

A fourth object of the present invention is to provide a printing method in which the energy required for development of colors is efficiently effected on the heat sensitive paper to thereby reduce the time required for printing and improve printing capability, in view of the above-described situation.

Furthermore, a fifth object of the present invention is to provide a printing mechanism which uses the aforesaid printing method to constitute a straight carrier path required for realizing high precision superposition of dots.

DISCLOSURE OF THE INVENTION

A substrate for a thermal head according to the present invention comprises: an exothermic resistor section in which exothermic resistors are provided; an IC mounting section on which an IC is mounted so as to energize the exothermic resistors; and a wiring section in which wiring is arranged to connect the exothermic resistor section and the IC mounting section; and a thickness of at least a part of the wiring section is smaller than that of the exothermic resistor section and the IC mounting section.

According to such a substrate for a thermal head, a thermal head can be manufactured such that the wiring section in which bending distortion does not become a problem is bent, but without bending the exothermic resistor portion and the IC mounting section where it is desired not to cause bending distortion. As a result, it becomes possible to prevent interference between an IC mounted in the IC mounting section and a heat sensitive paper, and to make the traveling route of the heat sensitive paper straight.

In the case of the double-line thermal head, two or more wiring sections are provided, and a thin portion may be formed in each of the wiring sections. Also, as the material of the substrate, metals such as iron alloy containing Ni and Al or stainless steel are preferable, but the material is not limited thereto.

On the other hand, the thermal head according to the present invention comprises a substrate, an insulating layer which is disposed on the substrate, with a raised portion being formed by raising a part of the surface thereof, and exothermic resistors formed on the raised portion, and a common electrode is disposed on the substrate, which protrudes from the surface of the substrate, penetrates through the raised portion and is connected to the exothermic resistors, to thereby divide the resistors into first exothermic resistors and second exothermic resistors, centering on the connecting point.

According to such a thermal head, after preheating of a heat sensitive paper is performed by the heating energy generated by the first exothermic resistors, at the time of printing, the heating energy of the second exothermic resistors is applied to effect the printing operation. Hence the energizing pulse of each exothermic resistor can be made short, thereby enabling reduction of the printing time.

Also, a thermal head according to the present invention may comprise a substrate on the central surface of which a common electrode portion having a predetermined length is protrudingly formed, a first insulating material formed on the surface of the substrate on one side of the common electrode portion, a second insulating material formed on the surface of the substrate on the other side of the common electrode portion, first exothermic resistors formed on the surface of the first insulating material with one end thereof being electrically connected to the common electrode portion, and second exothermic resistors formed on the surface of the second insulating material with one end thereof being electrically connected to the common electrode portion.

Moreover, the volume of the raised portion in the insulating layer surrounded by the first exothermic resistors and the common electrode may be formed larger than that of the raised portion in the insulating layer surrounded by the second exothermic resistors and the common electrode.

In this case, an effect can be obtained in that loss of the thermal energy generated by the first exothermic resistors is small, and is not affected by the amount of the thermal energy generated in the second exothermic resistors in printing of the next line, and thermal energy can be supplied as bias energy with high precision.

Furthermore, the raised portion in the insulating layer surrounded by the first exothermic resistors and the common electrode may be formed of a heat reserve material. In this case, since the raised portion in the insulating layer surrounded by the first exothermic resistors and the common electrode may be formed of a heat reserve material, heat can be transmitted to the heat sensitive paper efficiently. Hence heating energy generated by the first exothermic resistors can be efficiently used. The raised portion surrounded by the second exothermic resistors and the common electrode may be also formed of a heat reserve material.

The raised portion in the insulating layer surrounded by the first exothermic resistors and the common electrode may be formed thicker than other areas in the insulating film. In this case, since loss of the heat energy generated by the first exothermic resistors on the radiation fin (heat sink) side becomes small, an effect can be obtained in that the width of the energizing pulse to the second exothermic resistors can be made short.

The substrate is a metal substrate, and since this metal substrate and the common electrode are integrally formed, these have the same potential, and the metal substrate may have a function as an electrode. Moreover, the width of the common electrode in the traveling direction of the heat sensitive paper may be 2 mm or less.

Furthermore, the leads of the first exothermic bodies may be put together or united in a block unit and connected to a transistor. In this case, the number of transistors required is the same as the number of blocks. Also, in the above described thermal head, the second exothermic resistors may be provided ahead of the first exothermic resistors in the feed direction of the printing paper. When the first exothermic resistors are provided ahead of the second exothermic resistors in the feed direction of the printing paper, after the heat sensitive paper is heated to a threshold temperature immediately before developing color by the heat energy generated by the first exothermic resistors, the heating energy of the second exothermic resistors is added to thereby perform the printing operation. Hence, the energizing pulse to the second exothermic resistors can be made short, to thereby obtain an effect in that reduction of the printing time is possible.

On the other hand, the printing method according to the present invention is a method of developing color on a printing paper by heating it with exothermic bodies, characterized in that bias energy required at least for color development of the printing paper is given to the printing paper by first exothermic bodies, and then energy is applied by second exothermic bodies to a portion to be printed in the preheated portion to which the bias energy has been given, to thereby develop color on the printing paper in a desired gradation concentration. Thereby, the printing time can be shortened.

Moreover, a color printer according to the present invention comprises a heat sensitive paper on which a first coupler that develops a first color upon application of energy larger than a first color development energy, a second coupler that develops a second color upon application of energy larger than a second color development energy, and a third coloring material that develops a third color upon application of energy larger than a third color development energy are laminated and coated, a transport device which transports the heat sensitive paper in line units, and either one of the thermal heads described above, the surface of the thermal head is formed in a curved shape, and the thermal head is provided in the middle of a straight transport passage of the heat sensitive paper.

BEST MODE FOR CARRYING OUT THE INVENTION

Figure 12:
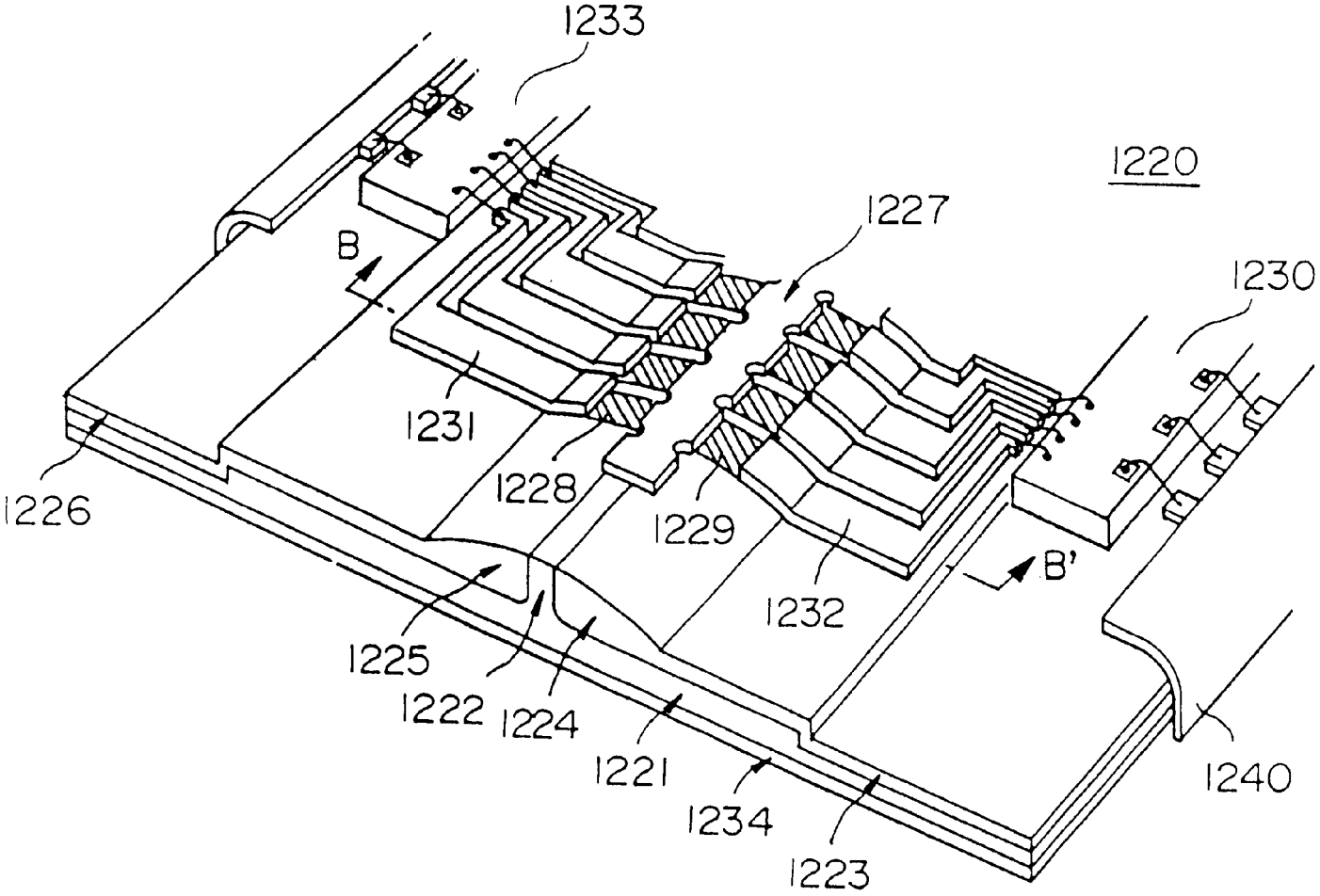
FIG. 12 is a perspective view showing one embodiment of a thermal head according to the present invention.
Figure 13:
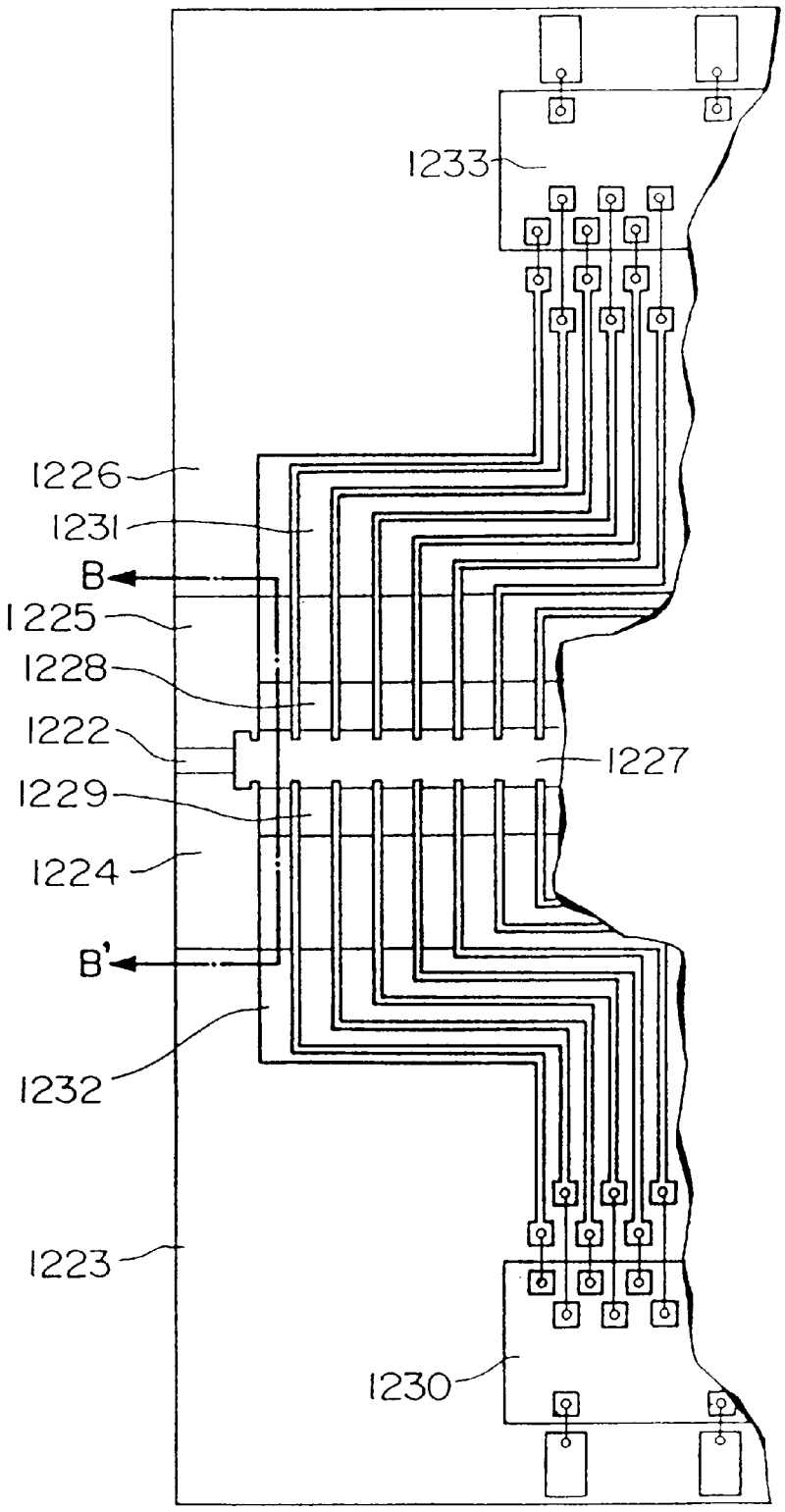
FIG. 13 is a plan view of the thermal head.

An embodiment of the present invention will now be described with reference to the drawings. FIG. 12 and FIG. 13 are, respectively, a perspective view and a plan view showing a double-line type thermal head, being one embodiment of the present invention, and FIG. 14 is a sectional view taken along the line B–B' in FIG. 13.

Reference symbol 1221 denotes a substrate consisting of a stainless steel or an iron alloy containing chromium and aluminum having a thickness of for example 0.8 mm. On the surface of this substrate 1221 is protrudingly formed a lengthy common electrode section 1222. The height of this common electrode section 1222 is for example 50 $\mu$m. Reference symbol 1234 denotes a glaze glass formed on the back of the stainless steel substrate 1221.

Figure 14:
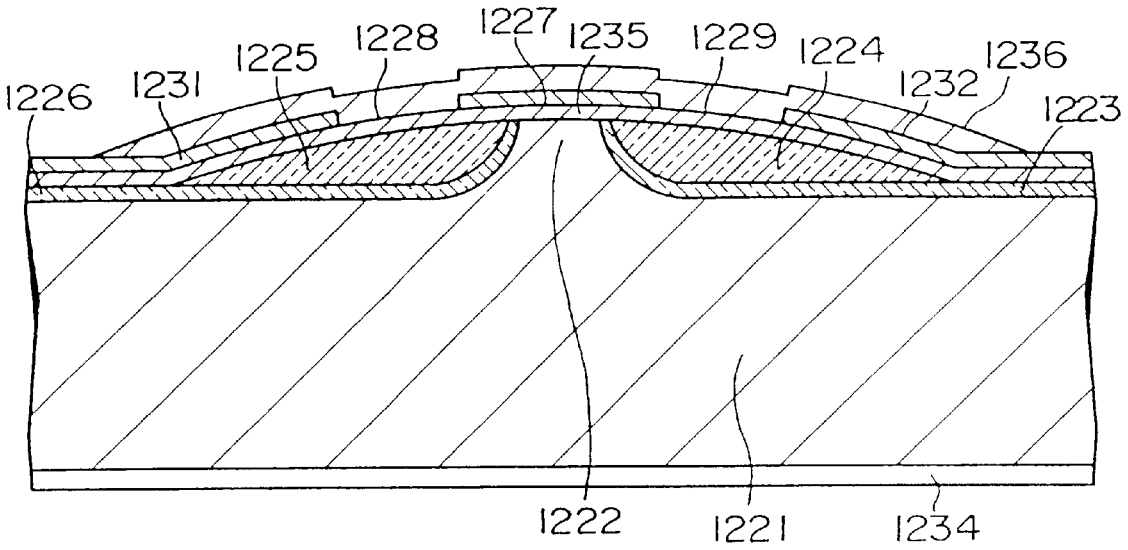
FIG. 14 is a sectional view taken along the line B–B' of the thermal head.

Reference symbol 1226 denotes a first glaze glass formed on the surface of the stainless steel substrate on the left side of the common electrode section 1222, as shown in FIG. 14, and the neighboring portion of the common electrode section 1222 is a raised portion 1225 formed by raising in a circular arc shape in section. Reference symbol 1223 denotes a second glaze glass formed on the surface of the stainless steel substrate on the right side of the common electrode section 1222 in FIG. 14, and the neighboring portion of the common electrode section 1222 is also formed by raising in a circular arc shape in section, and is designated as a raised portion 1224.

Reference symbol 1228 denotes first exothermic resistors, which are formed on a surface extending from the first partial glaze glass layer 1225 to the common electrode section 1222. These exothermic resistors 1228 are arranged in a plurality of numbers with a certain gap therebetween, corresponding to each one dot. A portion abutting against the surface of the common electrode section 1227 of each exothermic resistor 1228 is respectively electrically connected to the common electrode section 1227.

Figure 1:
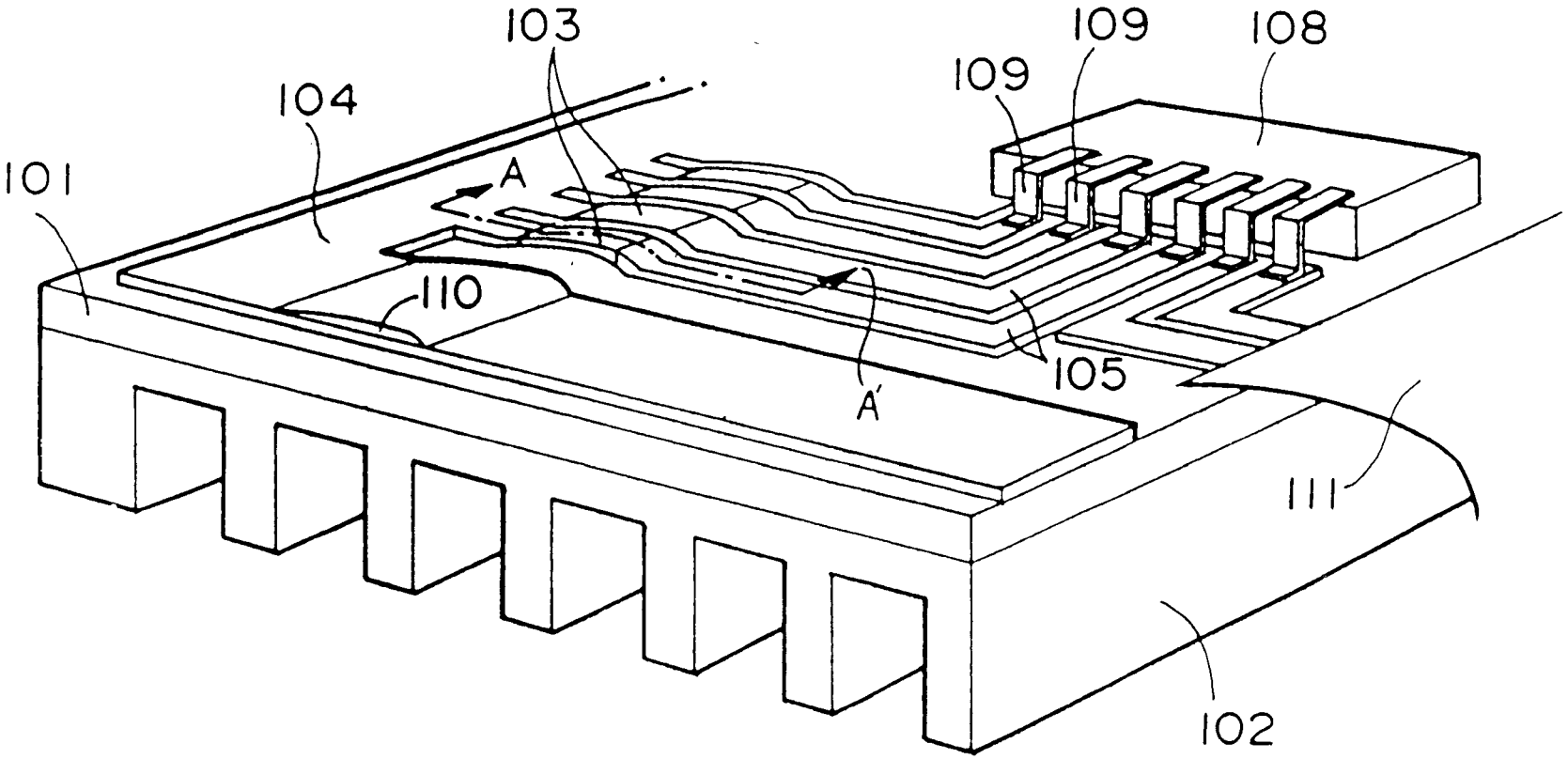
FIG. 1 is a perspective view of a conventional single-line thermal head.
Figure 2:
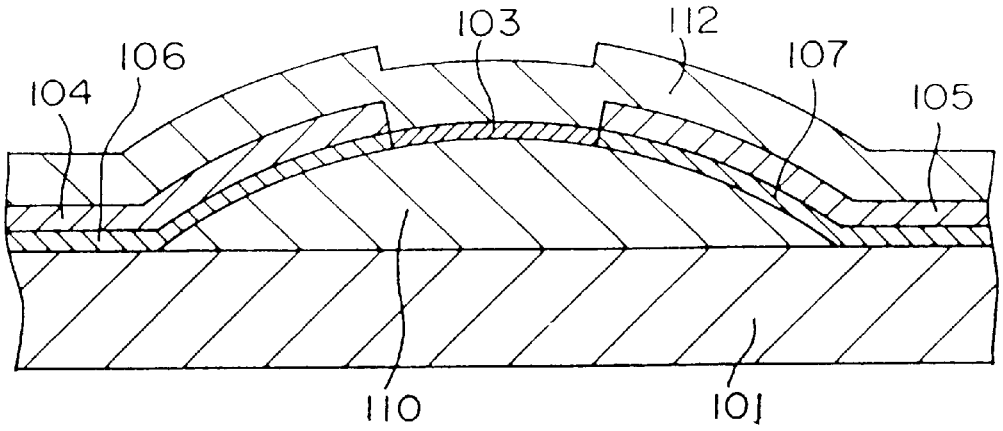
FIG. 2 is a sectional view taken along the line A–A' in FIG. 1.
Figure 3:
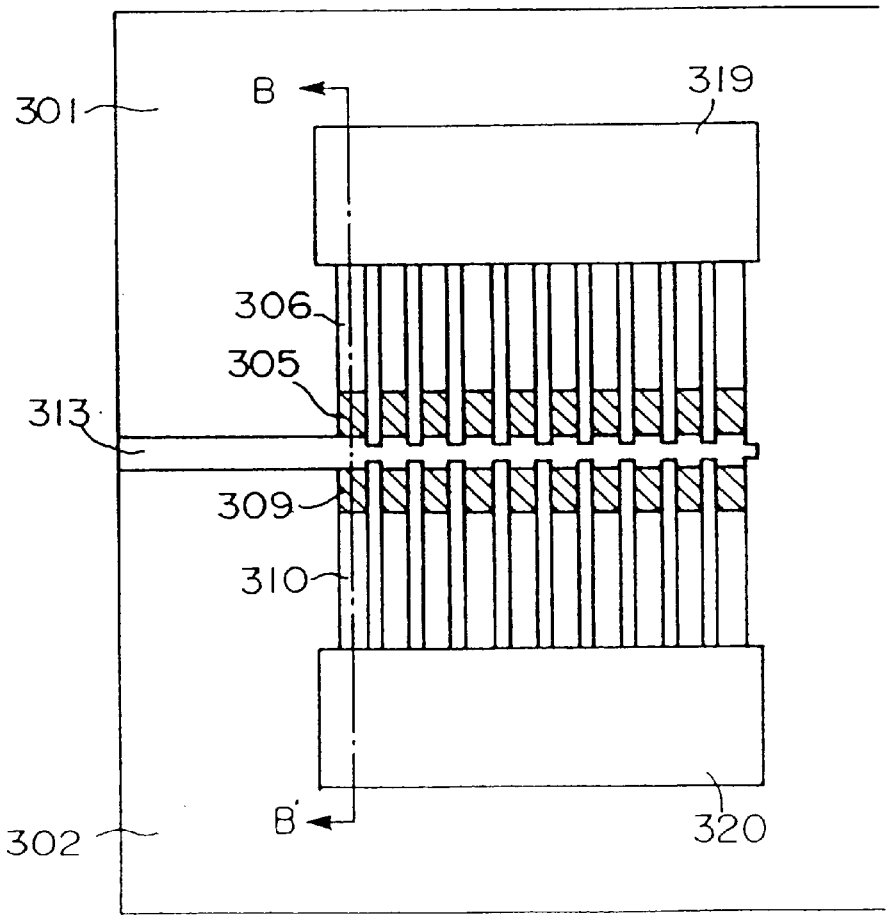
FIG. 3 is a plan view of a conventional single-line thermal head.
Figure 4:
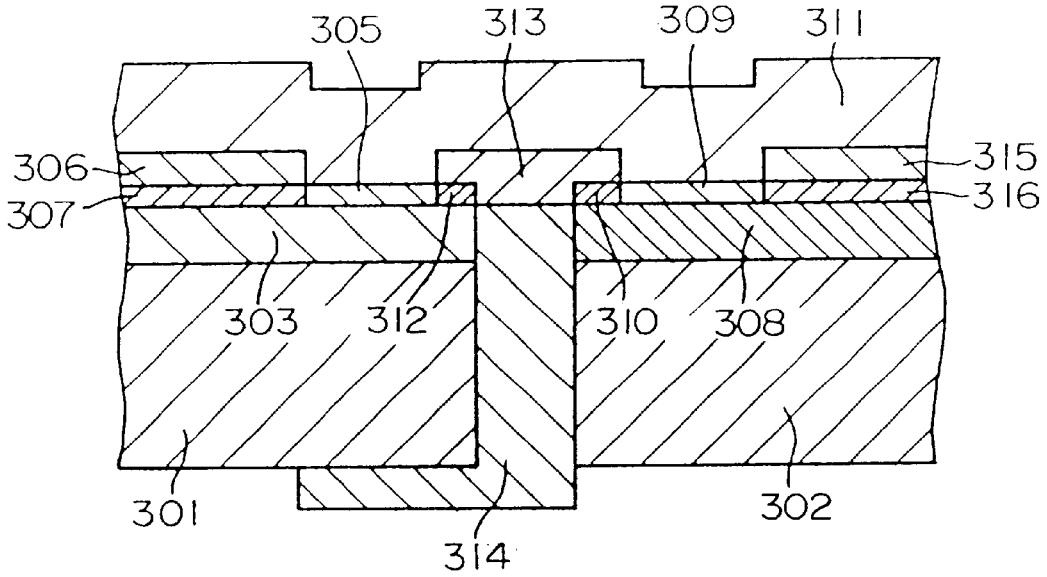
FIG. 4 is a sectional view taken along the line B–B' in FIG. 3.
Figure 5:
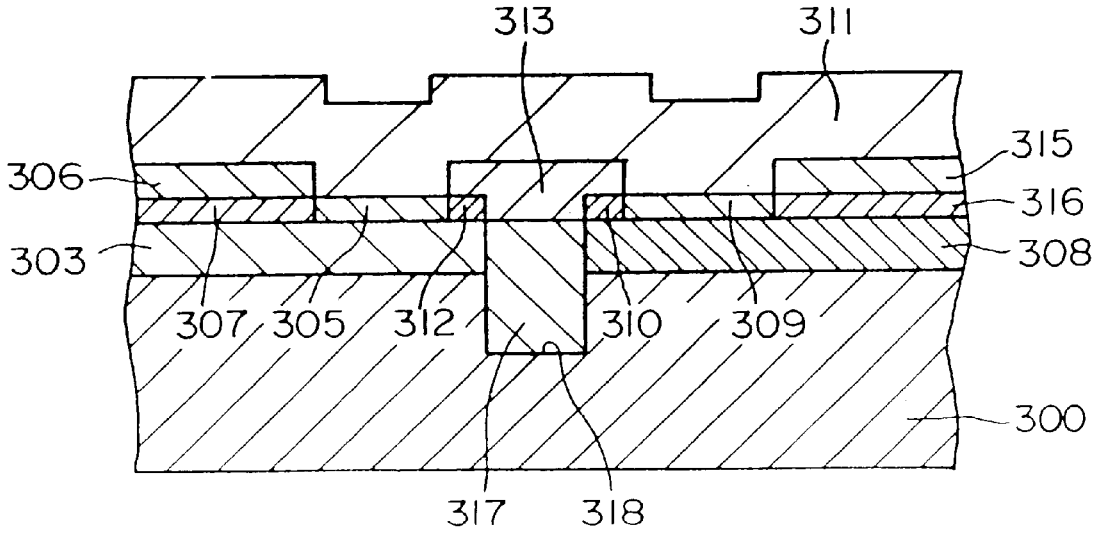
FIG. 5 is a sectional view of a conventional other double-line thermal head.

Reference symbol 1231 denotes first individual electrodes formed on the surface of the first partial glaze glass 1225, with one end portion thereof being electrically connected to one end portion of the exothermic resistor 1228, respectively. The other end portion of each first individual electrode 1231 is respectively connected to a terminal of a first control IC 1233. The first control IC has the same function as that of the control IC 108 shown in FIG. 1.

Reference symbol 1232 denotes a second individual electrode formed on the surface of the second glaze glass 1224, with one end portion thereof being electrically connected to the other end portion of the exothermic resistor 1229, respectively. The other end portion of each second individual electrode 1232 is respectively connected to a terminal of a second control IC 1230. The second control IC has the same function as that of the first control IC 1233. Between the individual lead electrodes 1231, 1232 and the exothermic resistors 1228, 1229, there is respectively formed a ultrathin thin film layer (not shown), having a function of preventing counter diffusion of each constituent as well as improving adhesion between the electrode film and the resistor film.

Reference symbol 1227 denotes a long and narrow rectangular common electrode wired along the common electrode section 1222 shown in FIG. 12, the back face of which is electrically connected to the surface of a resistor layer 1235 formed spanning over the glaze glass 1224, 1225 and the protruding portion 1222, as shown in FIG. 14. As a result, the resistor layer 1235 operates in such a manner that a portion put between the first individual electrode 1231 and the common electrode 1227 serves as the first exothermic resistor 1228, and a portion put between the second individual electrode 1232 and the common electrode 1227 serves as the second exothermic resistor 1229.

That is to say, the thermal head shown in FIG. 14 has a plurality of first exothermic resistors 1228 and a plurality of second exothermic resistors 1229. The first exothermic resistors 1228 are for generating bias energy necessary for preheating immediately before color development of a heat sensitive paper, and the second exothermic resistors 1229 are for generating gradation energy necessary for color development of the preheated heat sensitive paper. As shown in FIG. 14, a protection film 1236 is formed so as to cover the surface of the elements 1231, 1228, 1227, 1229 and 1232, to thereby improve the corrosion resistance and wear resistance thereof. FIG. 12 and FIG. 13 show a condition with the protection film 1236 removed.

On the substrate 1221, there is also fitted a flexible printed board 1240 for connection. Wiring connected to a controller of a printer body (not shown) is formed on this printed board 1240.

Figure 15:
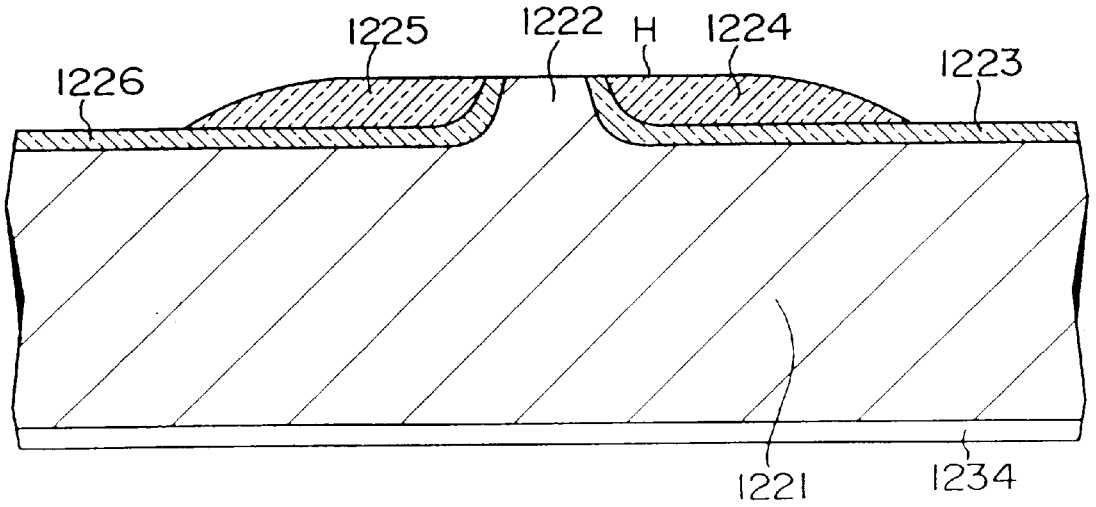
FIG. 15 is a sectional view showing a production method of the thermal head.

A production process of the thermal head will now be described, with reference to FIG. 14 and FIG. 15. FIG. 15 is a sectional view of the thermal head, seen from the line B–B', in the course of the production process. The production method of the glaze glass layer used herein corresponds to Japanese Examined Patent Application, Second Publication No. 7-12068, the contents of which are incorporated herein as a part of this specification.

With this method, a stainless steel substrate 1221 having a thickness of, for example, 0.8 mm is first degreased and cleaned using an organic solvent such as n-propyl bromide.

In order to remove dust on the surface of the stainless steel substrate 1221, the stainless steel substrate 1221 is then cleaned with a scrubber. Moreover, in order to remove dust adhered to the uneven surface of the stainless steel substrate 1221, the stainless steel substrate 1221 is cleaned by ultrasonic cleaning in a cleaning solution of methyl bromide. In order to polish the surface of the stainless steel substrate 1221, the surface of the stainless steel substrate 1221 is subjected to slow etching for two minutes, using a solution of ferric chloride containing, for example, $FeCl_3$: 50 g, HCl: 500 ml, and $H_2O$: 1000 ml.

A photoresist is then coated on the surface of a portion constituting the thermal head on the stainless steel substrate 1221. Then, patterning of the coated photoresist is performed by photolithography so that photoresist remains only on a portion where the common electrode 1222 is formed. The surface of the stainless steel substrate 1221 is etched to form the common electrode 1222, using the remaining photoresist pattern as a mask, in an oxalic acid solution containing $H_2C_2O_4.2H_2O$: 200 g and water: 2000 ml, with an electrode spacing of 20 mm, by applying 5V voltage to between electrodes, and at an etching rate of about 0.67 $\mu$m/min.

The height of the common electrode 1222 formed in a protruded condition by this etching can be monitored by a surface roughness measuring apparatus. In the above description, the common electrode 1222 on the stainless steel substrate 1221 is formed by etching. However, as other methods, there can be used, for example, polishing, cutting, rolling, pressing, or drawing, or processing methods combining these methods. In order to ensure dimensional accuracy, in particular, it is effective to combine processing methods, for example, to combine etching and polishing.

The stainless steel substrate 1221 is then fired at, for example, 900° C. for ten minutes, to thereby form an oxide film on the surface of the stainless steel substrate 1221. Then, a glass paste, being a glass forming material obtained by mixing a solvent and a glass powder is printed on the substrate 1221, as shown in FIG. 15, by a screen printing method using a mesh board, and fired at 850° C., to thereby form each glaze glass layer. In order to do this, the glass pastes 1226, 1223 are uniformly screen-printed on the surface of the stainless steel substrate 1221, except at the common electrode 1222. The thickness of these glass pastes 1226, 1223 is 20 $\mu$m. Then, the surface of the stainless steel substrate 1221 including the printed glass pastes 1226, 1223 is flattened.

Here, the glass pastes 1226, 1223 are pre-baked at 140° C., to thereby volatilize the solvent contained in the glass pastes so as not to give bumping. Next, after the temperature of the stainless steel substrate 1221 has dropped to room temperature, the glass paste 1234 is uniformly screen-printed on the lower face of the stainless steel substrate 1221. This glass paste 1234 is flattened, and then pre-baked at 140° C., to thereby volatilize the solvent contained in the glass paste.

The temperature of the furnace is then increased to 850° C., and the stainless steel substrate 1221 is heated in the furnace, to perform firing of the glass pastes 1226, 1223 on the surface of the stainless steel substrate 1221 and the glass paste 1234 on the lower face of the stainless steel substrate 1221, and then self-cooled until the temperature of the stainless steel substrate 1221 becomes room temperature. Here, the glass pastes 1226, 1223 become the glaze glass layers 1226, 1223. Then, glass pastes 1225, 1224 are screen-printed at a thickness of 30 $\mu$m, on the wall portions on the opposites sides of the common electrode 1222 and on the surface of the glaze glass layers 1226, 1223, using a metal mask.

The surface of the stainless steel substrate 1221 is then flattened, and the glaze glass layers 1225, 1224 on the opposite sides of the common electrode are pre-baked at 140° C., to thereby volatilize the solvent contained in the glass pastes 1225, 1224. Then, the temperature of the furnace is increased to 850° C., and the glass pastes 1225, 1224 on the opposite sides of the common electrode are fired to thereby form glaze glass layers 1225, 1224, respectively. Here, according to need, the surface of the common electrode 1222 and the glaze glass layers 1225, 1224 are polished by abrasive machining and buffing.

Then, a resistor of, for example, $TaSiO_2$ is formed by sputtering on each film formed on the stainless steel substrate 1221. A NiCr layer is then formed in a thickness of 0.1 $\mu$m by, for example, electron beam evaporation, as a mask on the upper part of the resistor layer. Then, patterning is performed by photolithography so that a photoresist remains on portions of the exothermic resistors 1228, 1229 and contact areas 1231, 1227 and 1232.

The NiCr layer is then etched in a ceric ammonium nitrate solution, using the photoresist pattern as a mask. Then, by removing the photoresist, the NiCr layer is subjected to patterning so as to be formed in a shape of the portions of the exothermic resistors 1228, 1229 and the contact areas 1231, 1227 and 1232. The resistor film is then etched using the NiCr layer as a mask, so that the resistor film is subjected to patterning to be formed in a shape of the portions of the exothermic resistors 1228, 1229 and the contact areas 1231, 1227 and 1232.

A binder thin film (not shown) is then formed in a thickness of, for example, 0.1 $\mu$m between the exothermic resistors 1228, 1229 and the aluminum electrodes 1231, 1227, 1232, in order to improve the adhesion so that the aluminum electrode can be formed in intimate contact with the exothermic resistors. The aluminum film as the electrode material is then formed by electron beam evaporation, and subjected to patterning by photolithography so that photoresist remains in areas where the electrode shape and the resistor shape are combined.

Thereafter, the aluminum film and the binder thin film are removed by phosphoric acid, using the photoresist pattern as a mask. By further removing the photoresist, the aluminum electrodes 1231, 1227, 1232 are formed. For example, SLALON (registered trademark) is formed as the protection film 1236 in a thickness of 5 $\mu$m. Then, the resistor is annealed by a heat treatment at 550° C. for one hour.

Though not shown, an insulating film is formed in the area where the control ICs 1233, 1230 are to be provided, and the control ICs 1233, 1230 are die-bonded on the insulating film in that IC arrangement area Each terminal of the control ICs 1233, 1230 and the individual lead electrodes 1231, 1232 are connected by wire bonding, and the control ICs, the wire bonding portion and a part of the individual lead electrodes 1231, 1232 are sealed by an epoxy resin.

Figure 6:
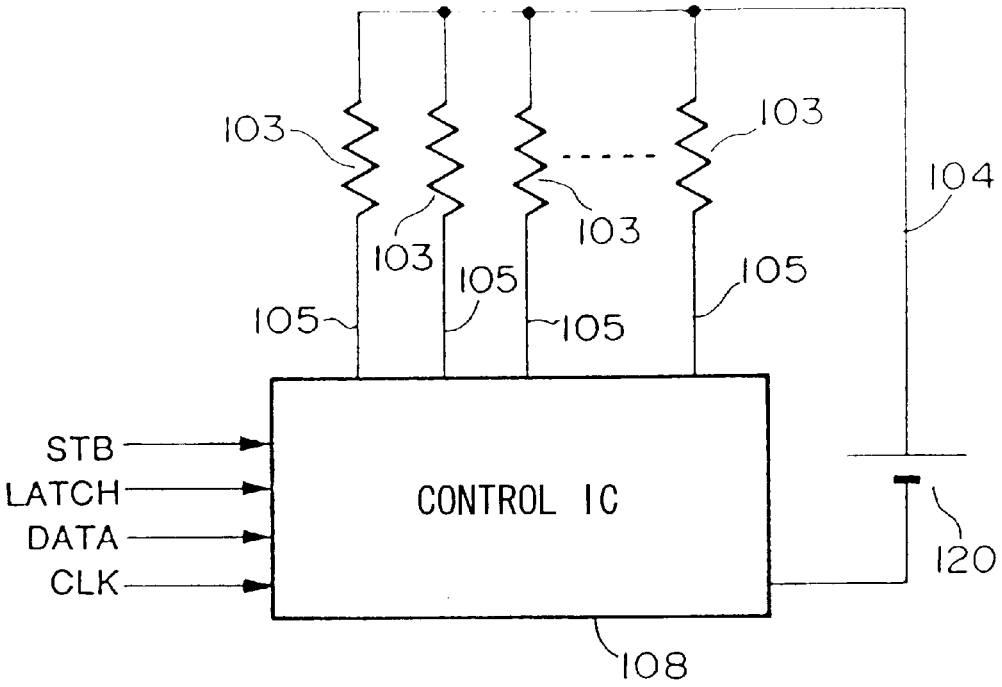
FIG. 6 is a circuit diagram of the thermal head shown in FIG. 1.
Figure 7:
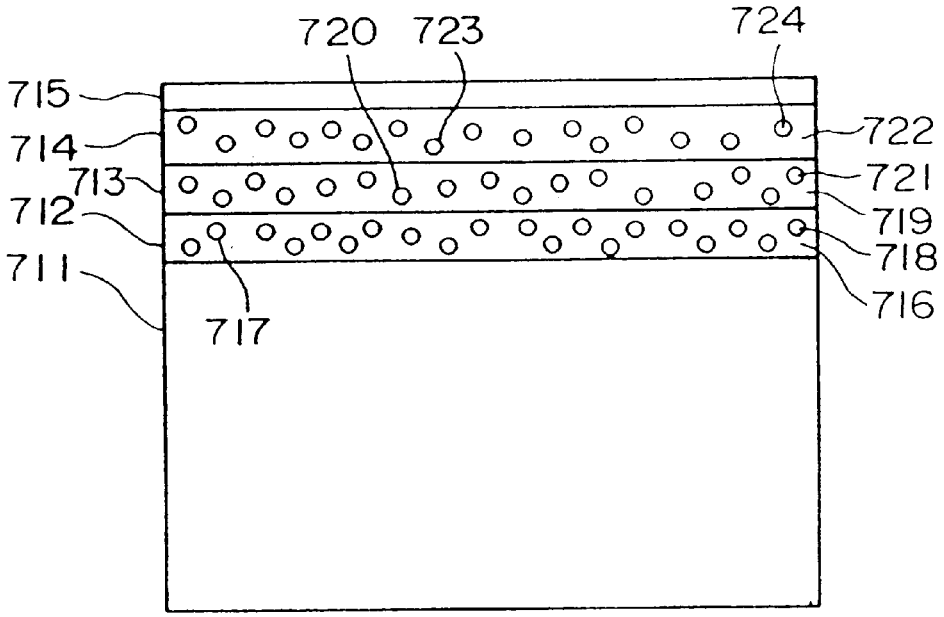
FIG. 7 is an enlarged sectional view of a heat sensitive paper for a conventional thermal head.
Figure 16:
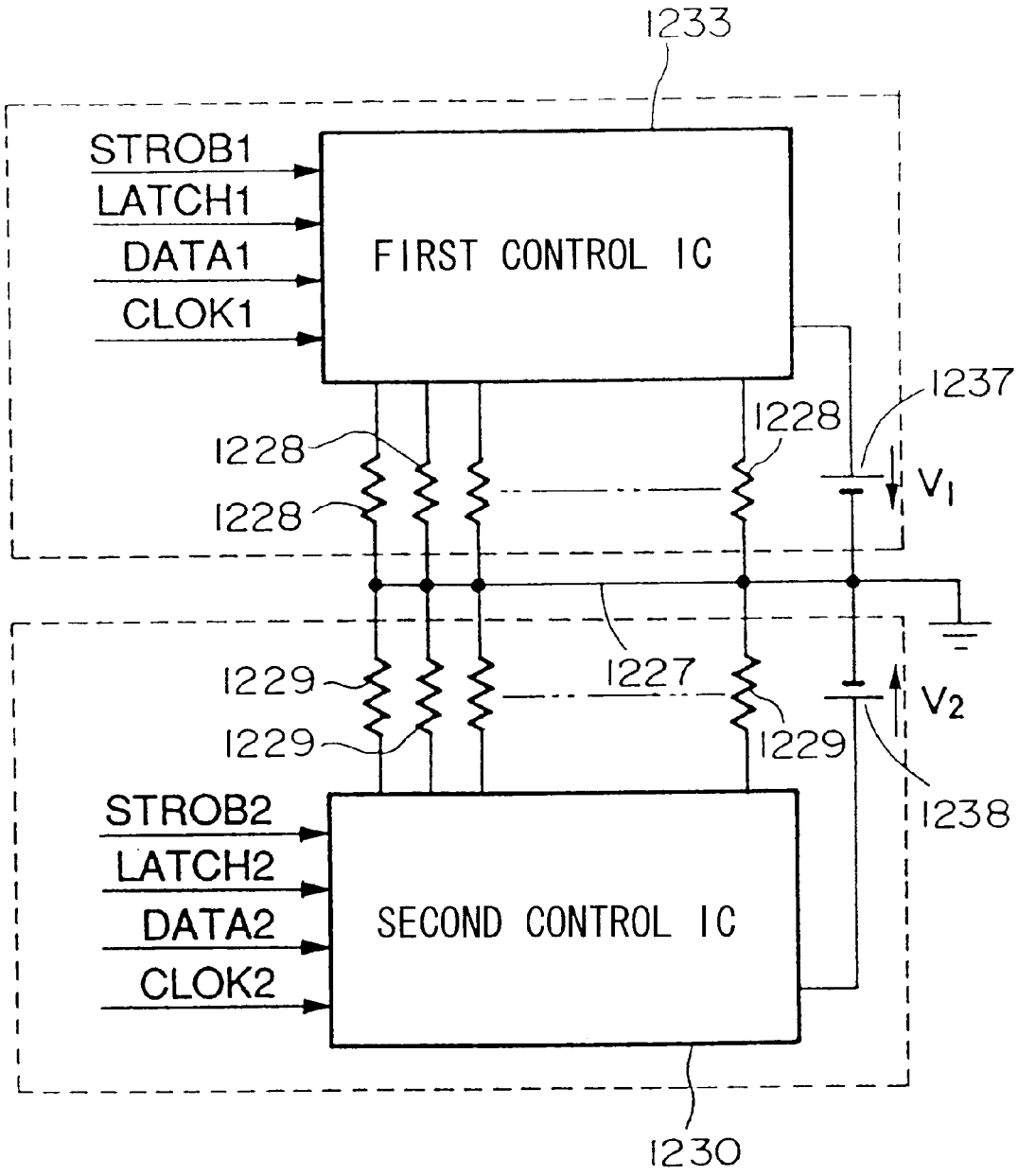
FIG. 16 is a circuit diagram of the thermal head.

FIG. 16 is an equivalent circuit of the thermal head according to this embodiment. This corresponds to the equivalent circuit of the conventional thermal head shown in FIG. 6, and as the exothermic body row, there are two rows of a first exothermic body 1228 and a second exothermic body 1229. Here the two equivalent circuits in FIG. 6 are formed by overlapping and joining the common electrode 1227 thereto. The circuit operation will be described later.

SECOND EMBODIMENT

Figure 17:
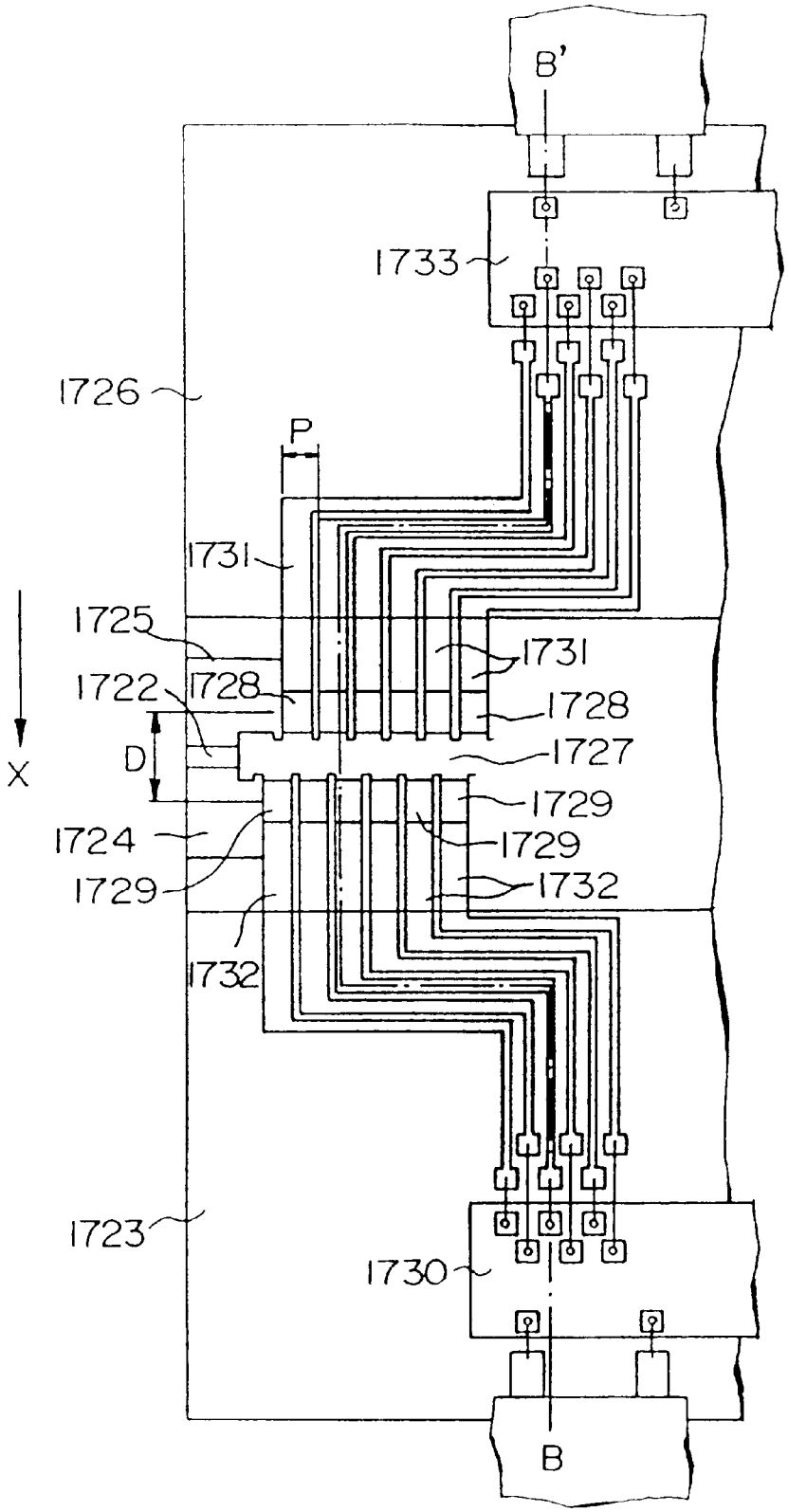
FIG. 17 is a plan view showing other embodiment of a thermal head according to the present invention.

An embodiment of a double-line thermal head having a different form from that of the above described double-line thermal head will now be described. FIG. 17 is a plan view of a thermal head in a dot shifted form, and corresponds to FIG. 13.

The different point of this embodiment and the double-line thermal head in FIG. 13 is that each first exothermic resistor 1728 and each second exothermic resistor 1729 are not formed on the same straight line in the paper feed direction at the time of printing (in the X direction shown in FIG. 17). That is to say, the pitch of the first exothermic resistor 1728 and the pitch of the second exothermic resistor 1729 are the same pitch (interval) P, but the adjacent first exothermic resistor 1728 and the second exothermic resistor 1729 are shifted by P/2 in a staggered form.

Reference symbol 1722 denotes a protrusion, being a common electrode section, 1723 denotes a second glaze glass layer, 1724 denotes a second portion glaze glass layer, 1725 denotes a first portion glaze glass layer, 1726 denotes a first glaze glass layer, 1727 denotes a common electrode, 1730 denotes a second control IC, 1731 denotes first lead electrodes, 1732 denotes second lead electrodes, and 1733 denotes a first control IC. Since these constituents are the same as those in the first embodiment, their description is omitted.

Figure 18A:
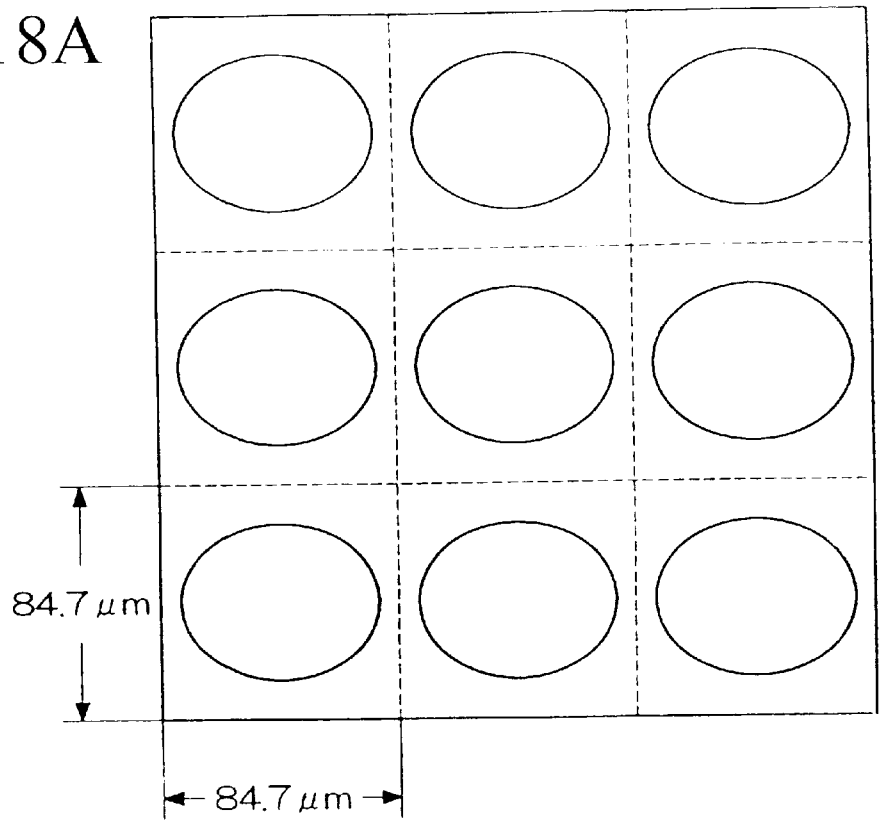
FIGS. 18A and 18B are plan views showing the operation of this embodiment.
Figure 18B:
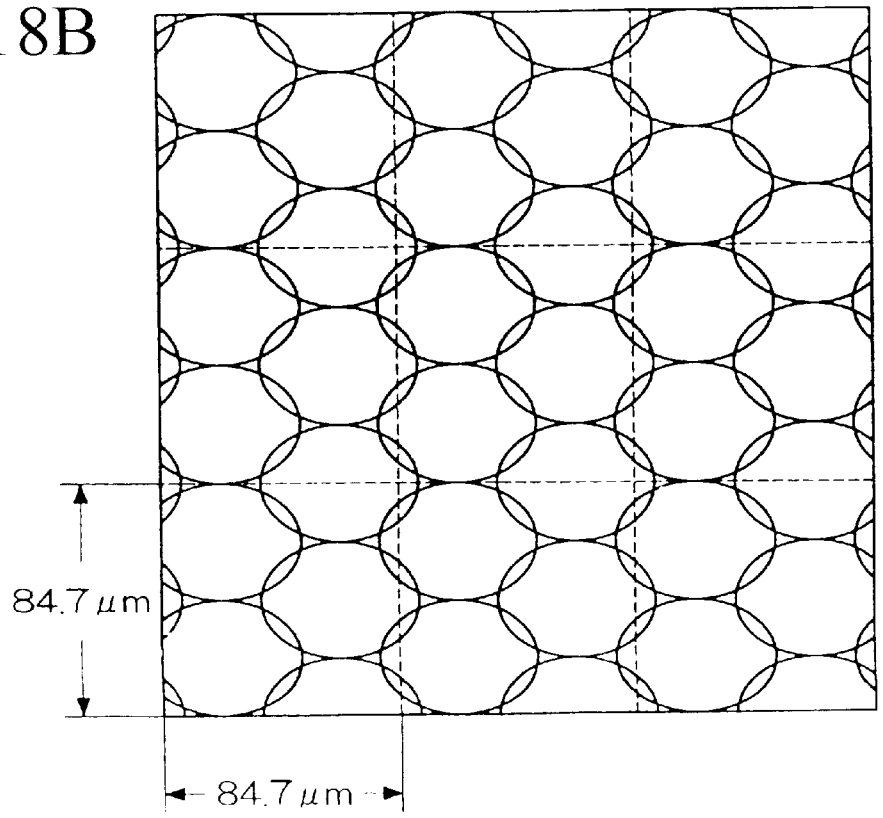

This dot shifted thermal head serves not only as a double-line thermal head, but also as a thermal head capable of printing at double density, as a secondary effect. That is to say, with this dot shifted thermal head, if it is assumed that the feed amount in the vertical scanning direction is one half of that for the simple double-line thermal head, and the distance D between the first exothermic resistor 1728 and the second exothermic resistor 1729 is a size represented by the following expression, the print dot pattern thereof becomes a pattern shown in FIG. 18B. Hence double dot density can be obtained both in the horizontal scanning direction and the vertical scanning direction, compared to the printing dot pattern shown in FIG. 18A of the simple double-line thermal head.

$$D=(n+\tfrac{1}{2})\times P \text{ (n is a natural number, } n\geq 1).$$

The production method of the above described dot shifted thermal head is the same as that for the double-line thermal head in the first embodiment. The operation of the circuit will be described later.

THIRD EMBODIMENT

Figure 19:
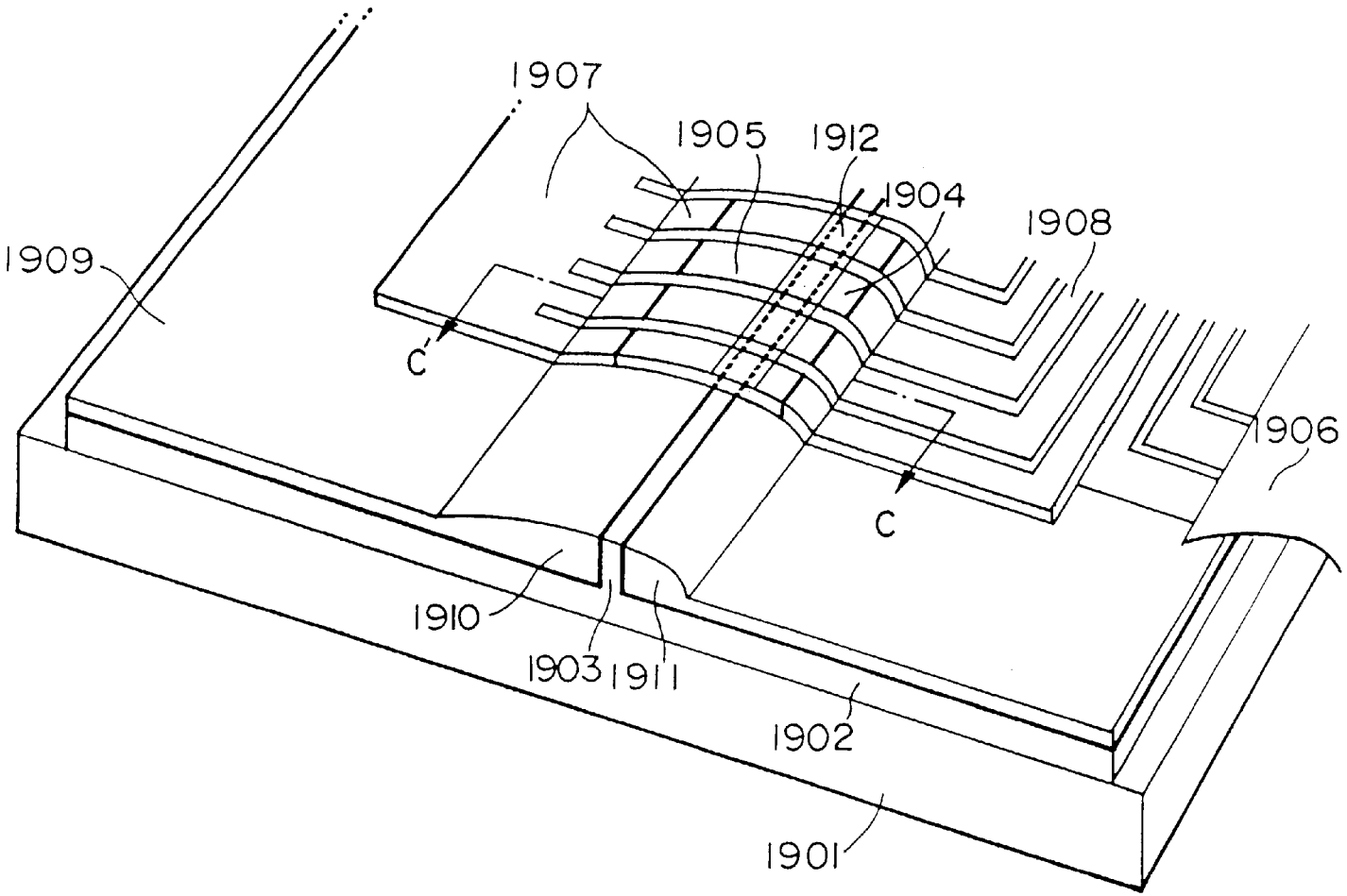
FIG. 19 is a perspective view showing another embodiment of a thermal head according to the invention.
Figure 20:
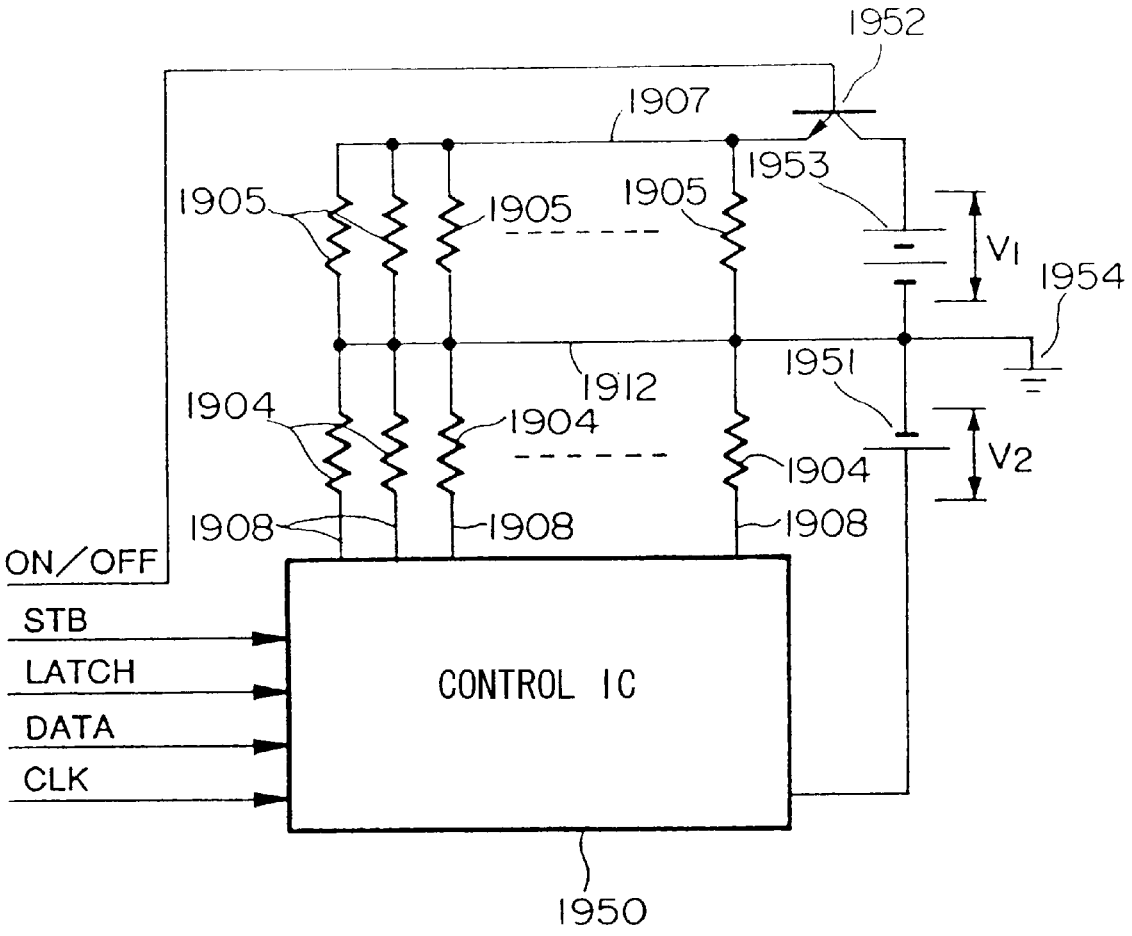
FIG. 20 is a circuit diagram of the thermal head.

FIG. 19 and FIG. 20 show a thermal head according to a third embodiment of the present invention. In this embodiment, while first exothermic bodies 1905 are used for preheating, gradation color development is performed by second exothermic bodies 1904. As shown in FIG. 20, each first exothermic body 1905 is connected collectively to a transistor 1952 via a collective electrode 1907. Though in FIG. 20, only one transistor 1952 is shown for convenience of explanation, the transistor 1952 may be in plural numbers, and in that case, the first exothermic bodies 1905 are divided into a plurality of blocks corresponding to the number of transistors, and connected to a separate transistor 1952 via a separate collective electrode 1907, separately for each block. The shape of a first portion glaze 1910 and a second portion glaze 1911 need not always be the same, and as shown in FIG. 19, the shape is optimized, taking into consideration the discharge characteristics of the exothermic bodies 1904, 1905, and may be different.

In FIG. 19 and FIG. 20, reference symbol 1901 denotes a heat sink, 1902 denotes a substrate consisting of a stainless steel or the like, 1903 denotes a protrusion, which is to be a common electrode section, 1906 denotes a flexible printed board, 1908 denotes a lead electrode, and 1909 denotes a glaze glass layer. These constituents are the same as those in the first embodiment and hence their description is omitted.

FIG. 20 shows an equivalent circuit of the thermal head shown in FIG. 19, wherein reference symbol 1950 denotes a control IC, which drives the exothermic resistors 1904, respectively, by voltage supplied from a power source 1951. Reference symbol 1952 denotes a drive transistor, and drives the exothermic resistors 1905, respectively, by voltage supplied from a power source 1953. Reference symbol 1954 denotes an earthed point, to which the common electrode 1912 of the exothermic resistors 1904 and 1905 are connected.

That is to say, the first exothermic bodies 1905 and the second exothermic bodies 1904 are connected in series for each dot, and connection points between each one end of the first exothermic bodies 1905 and each one end of the second exothermic bodies 1904 are earthed via the common electrode 1912. The other ends of the second exothermic bodies 1904 are connected to a control circuit (a control IC in the illustrated example) 1950 via individual electrodes 1908. This control IC 1950 is interposed between each second exothermic body 1904 and the power source 1951 to drive the second exothermic bodies 1904 with a predetermined power source, to thereby make the heat sensitive paper develop color at a predetermined gradation. Also, the other ends of the first exothermic bodies 1905 are connected to a collector of the switching transistor 1952. This switching transistor 1952 is to connect the first resistors 1905 to the power source 1953 by a signal supplied to the base. That is to say, by turning the switching transistor 1952 ON, the first exothermic bodies 1905 generate heat at a predetermined temperature.

The operation of this thermal head will be described with reference to FIG. 20. At first, a data signal DATA corresponding to each exothermic resistor 1904 is input to the control IC 1950, synchronized with a clock signal CLK having a constant period transmitted from a printer body (not shown), and information of the data signal DATA is stored in a storage section inside the control IC 1950, for example, upon "rise" of a latch signal LATCH. Based on the stored information, for example, when a strobe signal STB is "1", the exothermic resistors 1904 are energized to generate heat energy.

Moreover, upon energizing the exothermic resistors 1904, the control signal ON/OFF of the printer body becomes "1". As a result the drive transistor 1952 becomes ON condition, to thereby heat all the exothermic resistors 1905, and the heat energy is provide to a heat sensitive paper. That is to say, the heat energy corresponding to the heat energy heated by the pulse width $P_{BY}$, $P_{BM}$ and $P_{BC}$ of the bias pulse in FIG. 10 described above is provided for preheating and to the heat sensitive paper, and the next second exothermic bodies provide the remaining color development energies $P_{GY}$, $P_{GM}$ and $P_{GC}$ to effect color development. Hence the printing time is shortened by the time of pulse width $P_{BY}$, $P_{BM}$ and $P_{BC}$ of the bias pulse.

Figure 21:
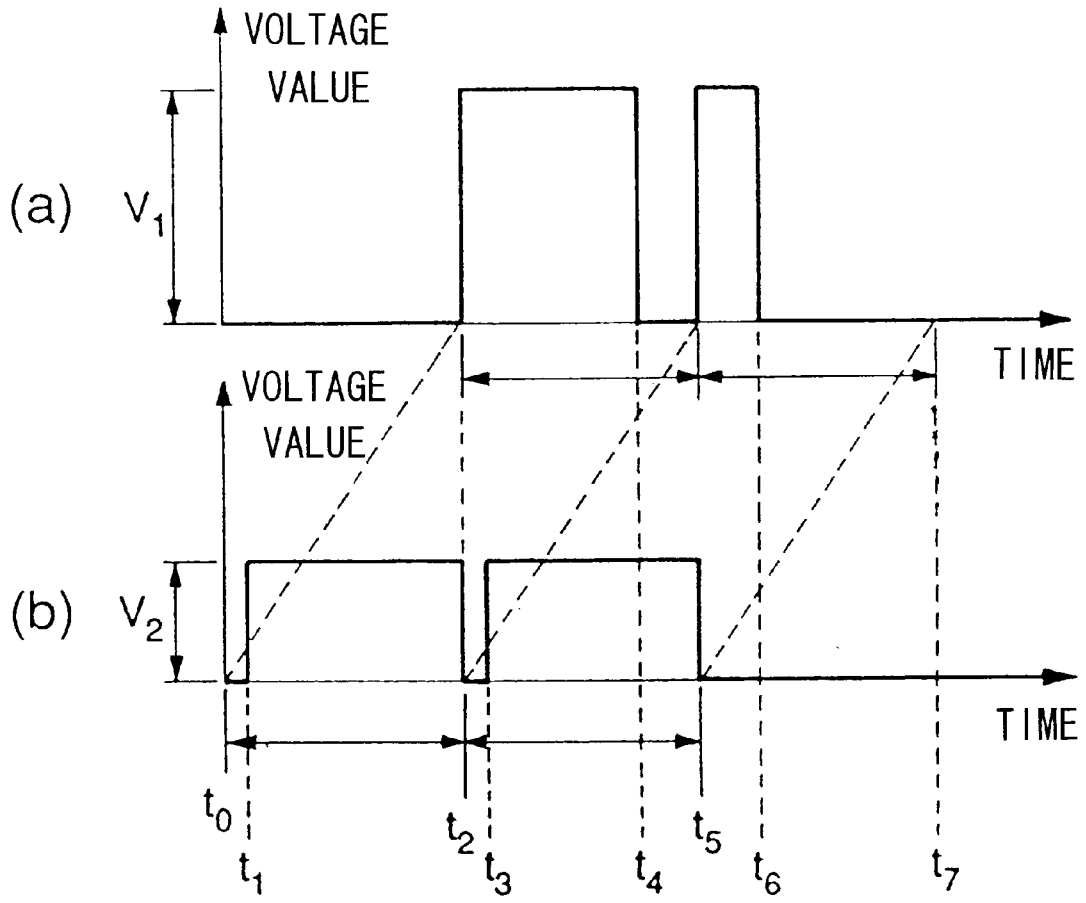
FIG. 21 is graph drive voltage of the thermal head.

The operation of the circuit in FIG. 20 will be described more specifically. FIGS. 21A and 21B show a case where printing is performed so as to provide 190 gradations in the first line and 64 gradations in the second line. FIG. 21A is a timing chart showing the pulse width of a strobe signal STB having a voltage value V2 for driving the second exothermic resistors 1904, and FIG. 21B is timing chart showing the pulse width of an ON/OFF signal ON/OFF having a voltage value V1 for driving the first exothermic resistors 1905. A period of printing one line is a time width shown by time t0 to t2, t2 to t5, and t5 to t7, respectively.

Figure 10:
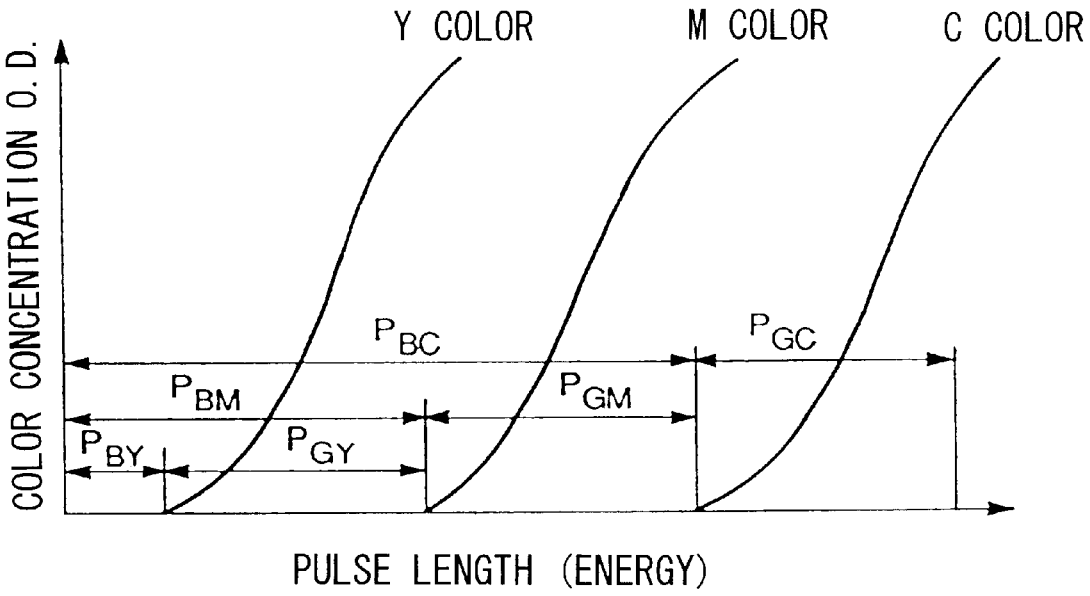
FIG. 10 is a graph showing each color concentration of a heat sensitive paper and an energizing pulse length.

The pulse width having a voltage value V1 for driving the first exothermic resistors 1905 is basically constant, when any correction is not made, and is an energizing time which is sufficient for generating bias energy corresponding to $P_{BY}$, $P_{BM}$ and $P_{BC}$ in FIG. 10. That is to say, the heat sensitive paper is preheated by heat energy generated by the first exothermic resistors 1905, because of being energized in the time t1 to t2. Then, in the time t2 to t5, the second exothermic resistors 1904 are supplied with voltage of the pulse width of the time t2 to t4, to thereby add the heat energy corresponding to the color concentration of 190 gradations, which is applied to the heat sensitive paper. As a result the heat sensitive paper develops color to the intended gradation concentration.

Moreover, the heat sensitive paper is preheated by the heat energy generated by the first exothermic resistors 1905, because of being energized in the time t3 to t5, and subsequently in the time t5 to t7, the second exothermic resistors 1904 are supplied with voltage of the pulse width of the time t5 to t6, to thereby apply the heat energy corresponding to the color concentration of 64 gradations to the heat sensitive paper, so that the printing operation is performed. That is to say, the heat energy generated by the first exothermic resistors 1905 is the threshold energy of color development of the heat sensitive paper, and the energy generated by the second exothermic resistors determines the gradation of the coloring concentration. In the equivalent circuit in FIG. 20, the common electrode 1912 is made to be an earthed circuit (load), however this is for only explanation. Actually, there are many cases where the common electrode 1912 is made to be a positive electrode, and as a result, the power supply construction becomes slightly different from that shown in FIG. 20.

Figure 8:
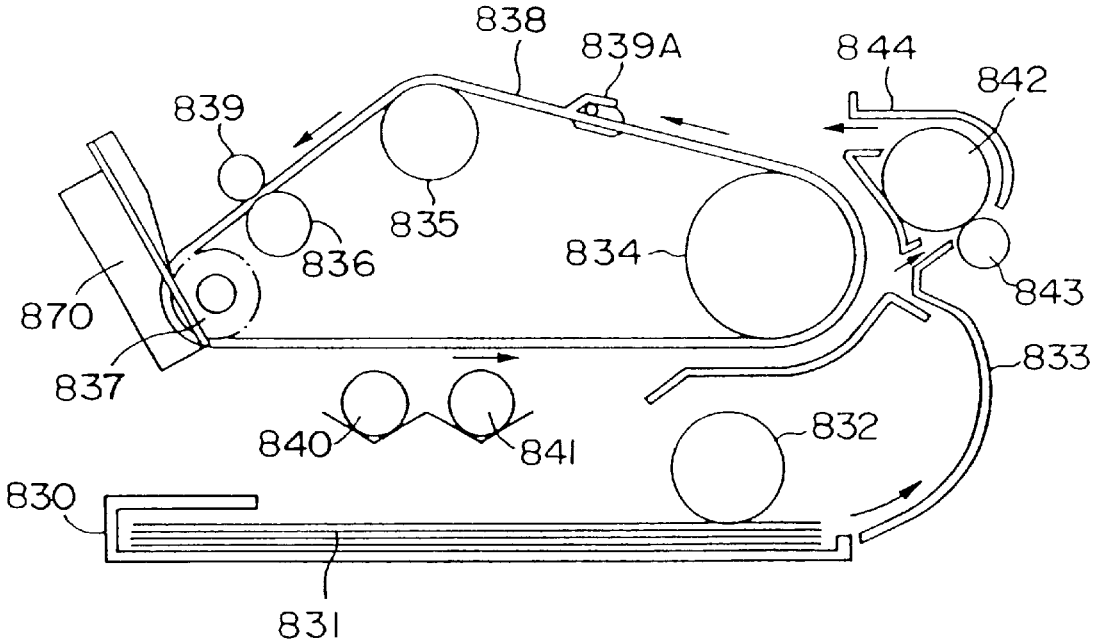
FIG. 8 is a schematic view of a conventional thermal printer.
Figure 9A:
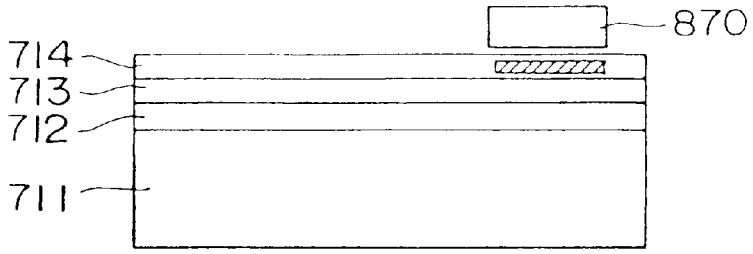
FIGS. 9A to 9E are sectional views showing a printing method using a heat sensitive paper.
Figure 9B:
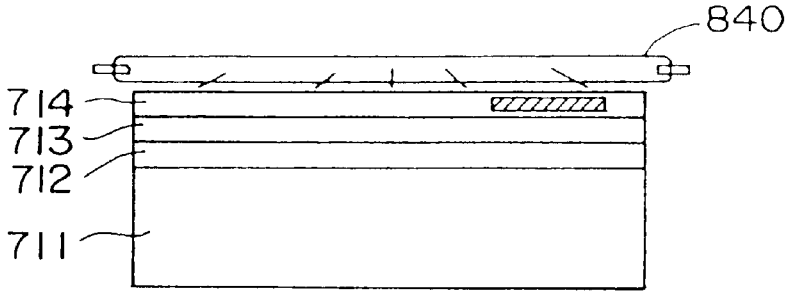
Figure 9C:
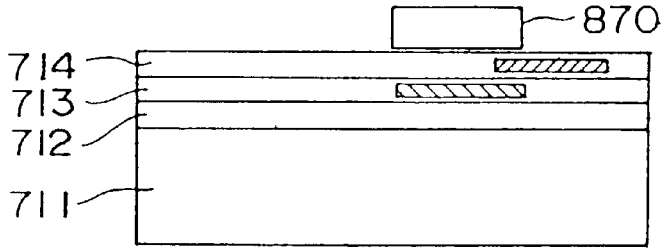
Figure 9D:
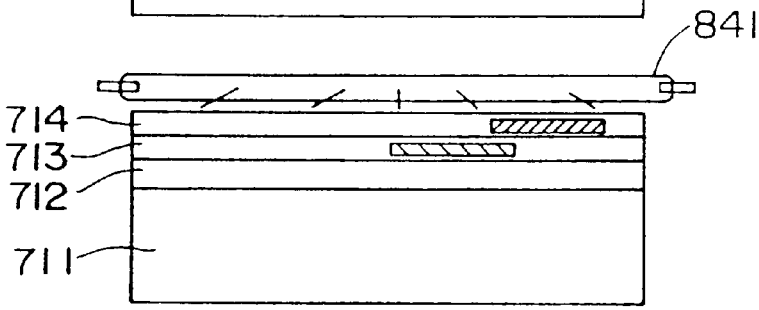
Figure 9E:
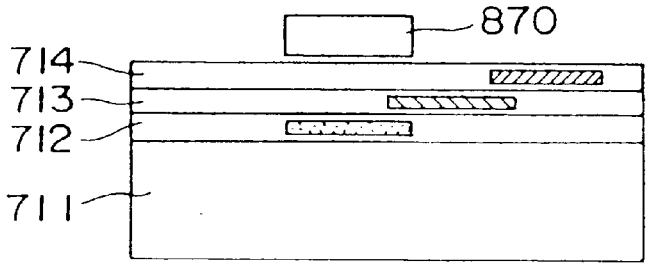

The thermal head having the above described construction is fitted to the printer and used as with the conventional thermal head, as shown in FIG. 8. That is to say, by repeating a processing for providing predetermined energy to the heat sensitive paper 831 between the platen roller 837 and the thermal head, with respect to each color of Y, M and C, while running the belt 838, each color is developed at a predetermined gradation.

A coloring operation by means of the above described thermal head will now be described. Energy required for color development will first be described. As described in the conventional example, in order to perform color development on the heat sensitive paper 831 at a predetermined gradation, the pulse length shown in the Expression (3) described above is necessary. If the relation of the Expression (2) described above is introduced therein, $$P_T=\{(P_{BY}+P_G)+(P_{BM}+P_G)+(P_{BC}+P_G)\}\times\text{number of lines}=\{(P_{BY}+P_{BM}+P_{BC})+(P_G+P_G+P_G)\}\times\text{number of lines}\approx\{3(P_{BY}+P_G)+3P_G))\}\times\text{number of lines} \quad \text{Expression (4)}$$

With the present invention, it is assumed that $3(P_{BY}+P_G)$: bias energy in the above Expression (4) is provided by the first exothermic bodies 1905, and $3P_G$: gradation energy is provided by the second exothermic bodies 1904 different from the first exothermic bodies 1905, and by increasing the density per unit time of the bias energy, the net printing time PT can be shortened to the time:

$$P_T\approx 3P_G\times\text{number of lines} \quad \text{Expression (5)}$$

substantially equal to the sum of the time required for providing the gradation energy with respect to each color. The time defined by the Expression (5) becomes ½ or ⅓ of the time defined by the Expression (3), and as a result, the printing time can be considerably reduced.

An example of voltage applied to each exothermic body 1905, 1904 will be described with reference to FIG. 20 and FIGS. 27A and 27B. When desired to print so as to provide 190 gradations for the first line and 64 gradations for the second line, then:

A) with respect to the Y color, in the former line (on the upstream side) by a distance corresponding to the 1 dot, a preheating Y color bias pulse of voltage V1 is added to the first exothermic bodies 1905. Then energy of 190 gradations is applied to the first line Ad: of the second exothermic bodies 1904, and at the same time, bias energy for the second line is applied to the first exothermic bodies. Subsequently, a pulse of voltage V2 of 64 gradations is applied to the second line, and at the same time, a bias pulse for the third line is applied; and B) with respect to the C color, in the former line by one line of each line, the preheating C color bias pulse of voltage V1 is applied to the first exothermic bodies 1905. Since this preheating C color bias pulse is larger than the Y color bias pulse, based on the above described color development principle, the bias pulse is supplied for a longer time than the case of the Y color. Then, a gradation pulse having the same length as that of the Y color is applied to the second exothermic bodies 1904. That is to say, since a large energy corresponding to the C color bias energy has been supplied in the first exothermic bodies 1904, the length of the gradation pulse to be provided in the second exothermic bodies 1904 becomes similar for each color.

With regard to the M color, since a bias energy intermediate between the Y color and the C color is required, the connection time of the bias pulse becomes the intermediate value. However, illustration of this pulse waveform is omitted.

In the case shown in the figure, because the sum (L) of the length of the first exothermic bodies 1905 and the width of the common electrode 1912 is set to be the same as the length of one dot, application of voltage to the first exothermic bodies 1905 is performed at a position of one dot before. However, when the value of L is set to be a value corresponding to the number of dots, for example, 2 dots, 3 dots, 4 dots or more, a bias pulse can be applied spanning over a plurality of lines from a position on the upstream side by 2 dots, 3 dots, 4 dots or more to a position of one dot before. Moreover, in the case shown in the figure, the bias energy required for each color is adjusted depending on the pulse length (application time of the pulse). However, the base current of the power transistor 1952 may be controlled and the applied voltage to the first exothermic bodies 1905 may be adjusted to thereby adjust the bias energy.

FIRST EMBODIMENT OF A THERMAL HEAD SUBSTRATE

Figure 22A:
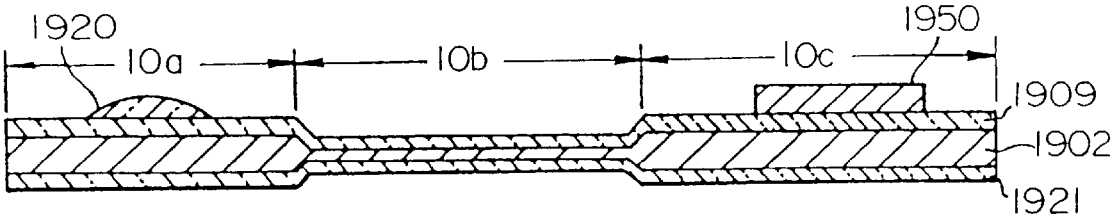
FIGS. 22A and 22B and FIGS. 23A to 23G are sectional views of a thermal head substrate according he present invention.
Figure 22B:
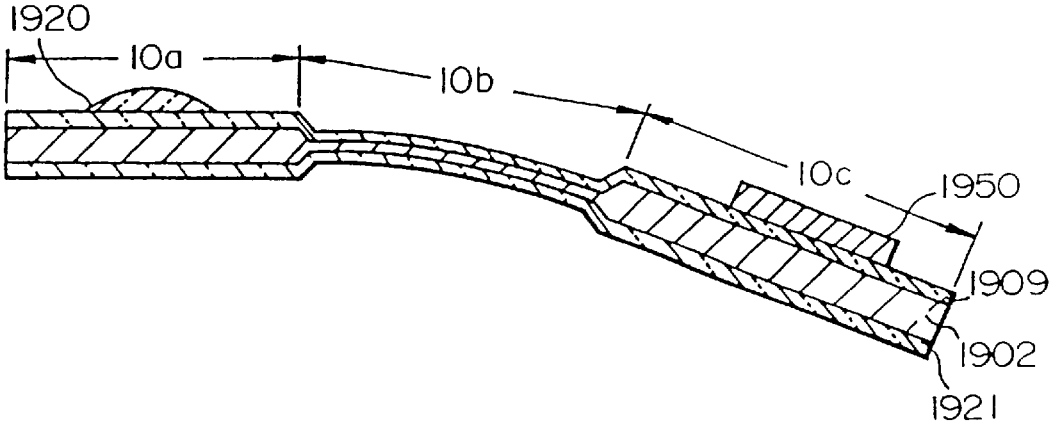

A first embodiment of a thermal head substrate according to the present invention in order to realize a curved-face structure of the thermal head is shown in FIGS. 22A and 22B. FIG. 22A is a sectional view of the thermal head substrate before bending, and FIG. 22B is a sectional view after bending. This thermal head substrate comprises exothermic resistors 10*a*, a wiring section 10*b*, and an IC mounting section 10*c*. The thermal head substrate comprises a metal substrate 1902 consisting of a stainless steel or the like, and a portion corresponding to the wiring section 10*b* of this metal substrate 1902 is made thin by a normal method such as rolling, cutting, grinding, polishing or etching. A glaze glass layer 1909 is formed on the surface of the metal substrate 1902, and a back face glaze glass layer 1921 is formed on the back surface thereof. Also, a partial glaze

1920 is formed on the exothermic resistor 10*a*, and a control IC 1950 is fixed on the IC mounting section 10*c*.

SECOND TO EIGHTH EMBODIMENTS OF THE THERMAL HEAD SUBSTRATE

FIGS. 23A to 23G show second to eighth embodiments of the thermal head substrate, wherein reference symbols 1902*a* to g denote a metal substrate, 1909*a* to g denote a glaze glass layer, 1921*a* to g denote a back face glaze glass layer.

Figure 23A:
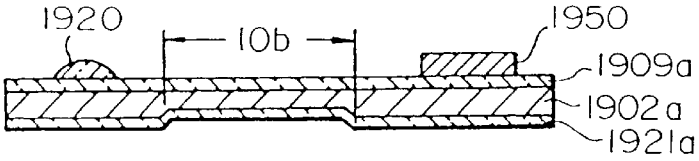

The second embodiment shown in FIG. 23A, is characterized in that a relatively thin wiring section 10*b* is formed, by forming a concave portion on the lower face of the metal substrate 1902*a*.

Figure 23B:
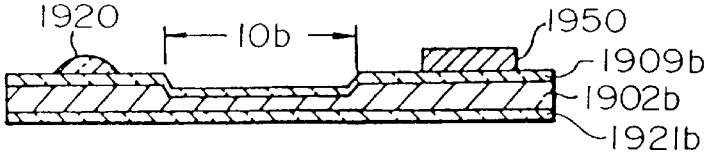

The third embodiment shown in FIG. 23B, is characterized in that a thin wiring section 10*b* is formed, by forming a concave portion on the upper face of the metal substrate 1902*b*.

Figure 23C:
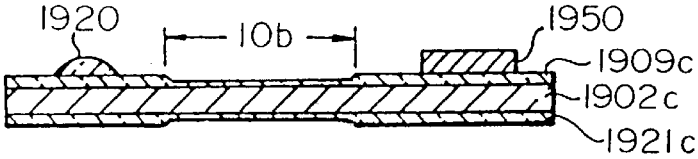

In the fourth embodiment shown in FIG. 23C, a thin wiring section 10*b* is formed, by making the glaze glass layer 1909 and the back face glaze glass layer 1921*c* thin, instead of making the metal substrate 1902*c* thin.

Figure 23D:
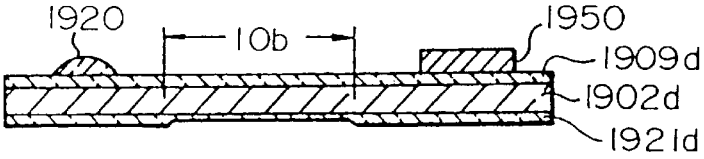

In the fifth embodiment shown in FIG. 23D, a thin wiring section 10*b* is formed, by making only the back face glaze glass layer 1921*d* thin, instead of making the metal substrate 1902*d* thin.

Figure 23E:
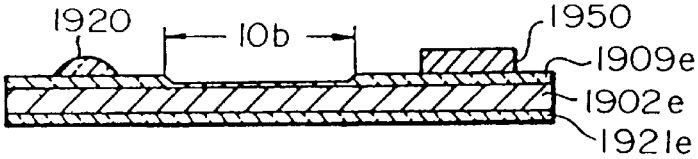

In the sixth embodiment shown in FIG. 23E, a thin wiring section 10*b* is formed, by making only the glaze glass layer 1909*e* thin, instead of making the metal substrate 1902*e* thin.

Figure 23F:
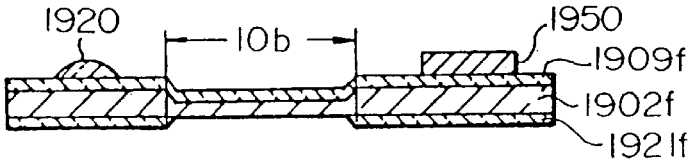

In the seventh embodiment shown in FIG. 23F, a thin wiring section 10*b* is formed, by forming a concave portion on the upper face of the metal substrate 1902*f*, and removing the back face glaze glass layer 1921*f* on that portion.

Figure 23G:
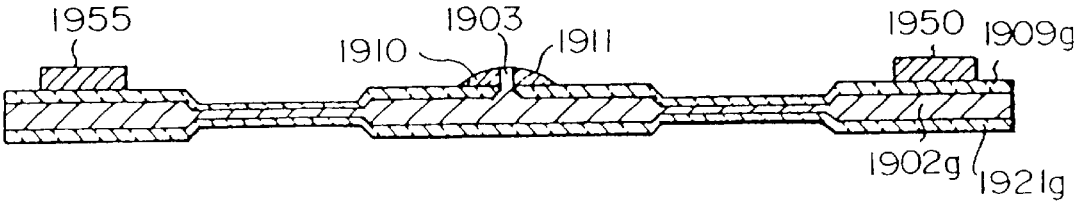

The eighth embodiment shown in FIG. 23G is applied to a substrate for a double-line thermal head, wherein a common electrode protrusion 1903 is formed in the center on the surface of the metal substrate 1902*g*, and thin portions are formed on the opposite sides thereof to form a pair of thin wiring sections 10*b*. On the opposite sides of the common electrode protrusion 1903, there are formed crystalline glass pastes 1910, 1911, and control ICs 1955, 1950 are fixed at the opposite ends of the substrate (IC mounting sections 10*c*).

FOURTH EMBODIMENT OF THE THERMAL HEAD

Figure 24:
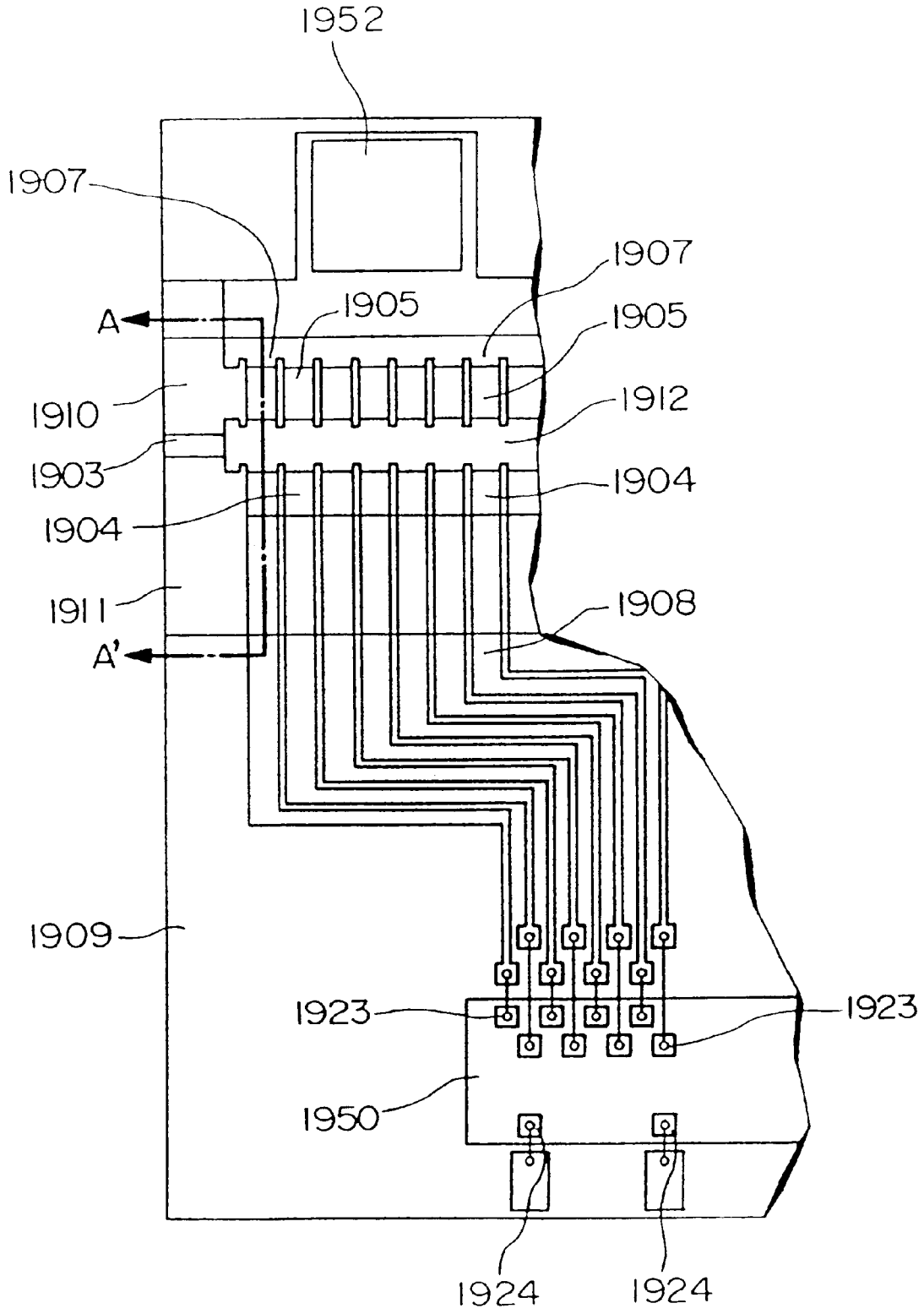
FIG. 24 is a plan view showing other embodiment of a thermal head according to the present invention.

An embodiment where a thermal head substrate for the above described curved-face structure is applied to a thermal head having a preheating function will be described. FIG. 24 is a plan view of a thermal head having a curved-face structure, wherein a common electrode protrusion 1903 is formed on the surface of a metal substrate 1902 consisting of a stainless steel or the like. Moreover, there is respectively formed a glaze glass layer 1909, a first partial glaze 1910 and a second partial glaze 1911. On the surface of the glaze uplift, there are formed a plurality of gradation exothermic resistors 1904 and preheating exothermic resistors 1905 corresponding to each one dot at the time of printing. The gradation exothermic resistors 1904 generate heat corresponding to the pulse width of supplied pulse voltage for gradation control, and the preheating exothermic resistors 1905 generate heat corresponding to the pulse width of supplied pulse voltage for preheating, so as to be transmitted to a color heat sensitive paper (not shown), respectively.

A common electrode section 1903 is formed on the surface of the metal substrate 1902, and each one end portion of the gradation exothermic resistors 1904 and the preheating exothermic resistors 1905 are connected to this common electrode section 1903 via a common electrode 1912. Moreover, individual lead electrodes 1908 connected to one end portion of each gradation exothermic resistor 1904 are respectively formed on the surface of the metal substrate 1902, and a lead electrode 1907 connected to one end portion of each preheating exothermic resistor 1905 is also formed thereon, and this lead electrode 1907 is connected to an emitter terminal of a power transistor 1952.

Lead pad portions are formed at the other end portions of the individual lead electrodes 1908, and these lead pad portions are connected to terminals 1923 of the control IC 1950 via a lead, respectively.

The control IC 1950 controls the supply of pulse voltage to the gradation exothermic resistors 1904, based on the yellow printing data supplied from the control section (not shown) via the flexible substrate, connection terminal pattern and lead pads.

Figure 25:
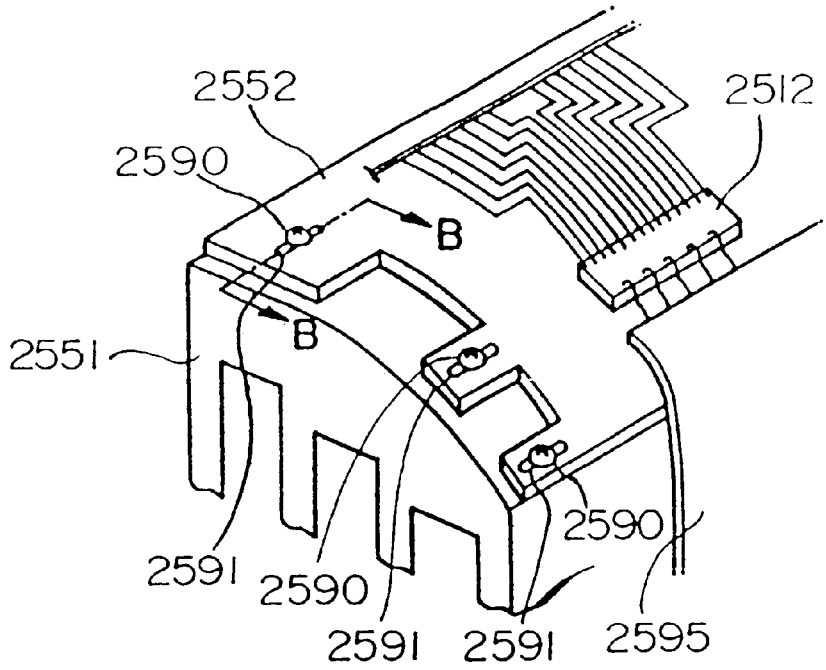
FIG. 25 is a perspective view showing another embodiment of a thermal head according to the present invention.

FIG. 25 is a conceptual view showing a method of fitting the thermal head substrate shown in FIG. 24 to the heat sink. As shown in this figure, the metal substrate 2552 is bent along the curved upper face of the heat sink 2551, and fixed to the heat sink 2551 by a screw 2590 penetrating through an elliptic hole 2591. A flexible wiring substrate 2595 is fixed to the metal substrate 2552, and a signal for controlling the control IC 2512 is transmitted from the printer control section (not shown) via this flexible wiring substrate 2595.

Figure 26:
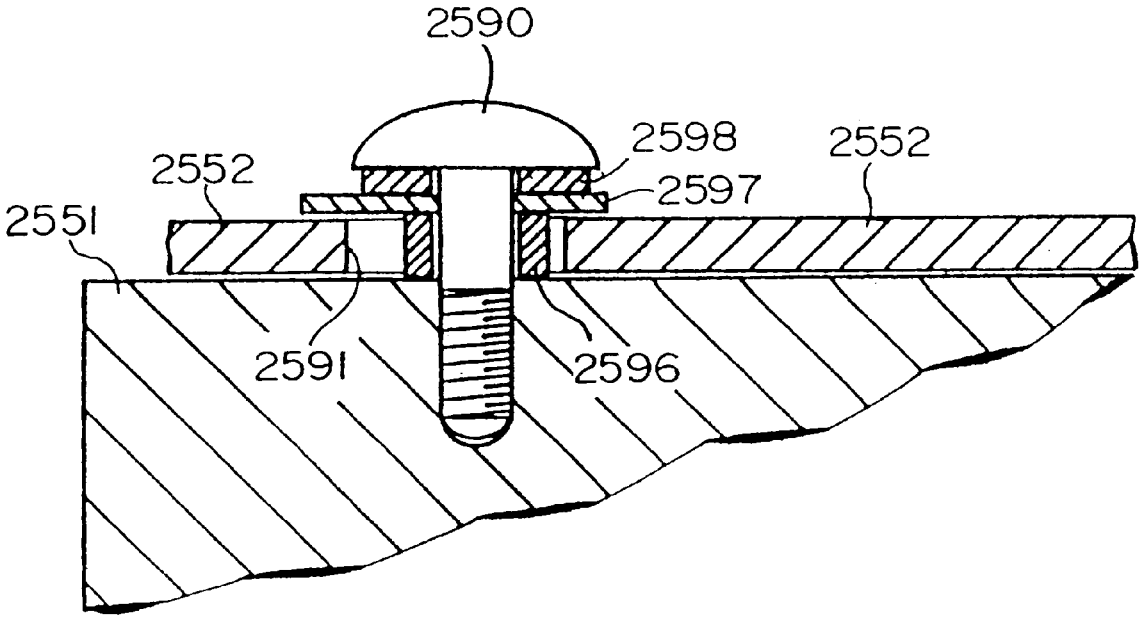
FIG. 26 is a sectional view taken along the line B–B' in FIG. 25.

FIG. 26 shows a structure for fixing the metal substrate 2552 to the heat sink 2551. An external screw hole is formed in the heat sink 2551, and a screw 2590 penetrating through the elliptic hole 2591 of the metal substrate 2552 is fastened into this external screw hole, thereby fixing the metal substrate 2552 to the heat sink 2551. A spacer 2596 which can be fitted in the elliptic hole 2591 is penetrated through by the screw 2590, and a washer 2597 for pressing the metal substrate 2552 and a spring washer 2598 for preventing slack are also penetrated therethrough.

The length of the spacer 2596 is slightly longer than the thickness of the metal substrate 2552 (for example, 100 $\mu$m or less). As a result, the metal substrate 2552 is fixed slightly movably with respect to the heat sink 2551, and pressed against the heat sink 2551 with the washer 2597. Accordingly, by adjusting the tightening condition of the screw 2590, a force of the washer 2597 for pressing the metal substrate 2552 against the heat sink 2551 can be adjusted.

Moreover, since the elliptic hole 2591 is formed in an elliptic shape longer in the longitudinal direction of the metal substrate 2552, even if a difference in sizes of the metal substrate 2552 and the heat sink 2551 occurs because of the bimetal effect due to the different linear thermal expansion coefficient of the metal substrate 2552 and the heat sink 2551, the metal substrate 2552 slides on the heat sink 2551, with the screw 2590 as a reference position. As a result, it is possible to alleviate a stress acting on the metal substrate 2552 resulting from the difference in the coefficient of thermal expansion.

The printing operation of the thermal head having the curved structure shown in FIG. 25 will now be described, with reference to FIGS. 27A and 27B and FIG. 28. In FIG. 28, a yellow color fixing lamp 55Y is arranged on the right side of the yellow thermal head 44Y, and irradiates the above described light having a peak wavelength of 420 nm onto the surface of a color heat sensitive paper 40. The construction of this yellow color fixing lamp 55Y is the same as the yellow fixing lamp 1121Y shown in FIG. 11. That is to say, this yellow color fixing lamp 55Y fixes yellow in the yellow recording layer of the heat sensitive paper 40.

Reference symbol 56 denotes a platen roller arranged on the right side of the platen roller 43 with a distance D, and transports the color heat sensitive paper 40 for one line in the direction of an arrow Z shown in this figure, synchronously with the platen roller 43. The above distance D is normally the same length as or shorter than the printing length of one sheet of the heat sensitive paper 40*a*, in other words, the length in the longitudinal direction. Reference symbol 44M denotes a magenta thermal head arranged above the platen roller 56, and used for printing of the magenta color. The thermal heads 44Y and 44M are thermal heads having a curved face shown in FIG. 25 described above.

Reference symbol 55M is a magenta color fixing lamp arranged on the right side of the magenta thermal head 44M, and irradiates the above described light having a peak wavelength of 365 nm onto the surface of the color heat sensitive paper 40. The construction of this magenta color fixing lamp 55M is the same as the magenta fixing lamp 1121 M shown in FIG. 11. That is to say, the magenta color lamp 55M fixes magenta color in the magenta recording layer of the heat sensitive paper 40.

Reference symbol 57 denotes a platen roller arranged on the right side of the platen roller 56 with a distance D, and transports the color heat sensitive paper 40 for one line in the direction of the arrow Z shown in this figure, synchronously with the platen rollers 43 and 56. Reference symbol 44C denotes a cyan thermal head arranged above the platen roller 57, and used for printing of the cyan color. This cyan thermal head 44C is a thermal head having a curved face shown in FIG. 25.

Reference symbol 55C is a bleaching lamp arranged on the right side of the cyan thermal head 44C, and irradiates light of a predetermined wavelength onto the surface of the color heat sensitive paper 40. The construction of this bleaching lamp 55C is the same as that of the bleaching lamp 1121C shown in FIG. 11. That is to say, the bleaching lamp 55C bleaches the undeveloped portion on the color heat sensitive paper 40.

Reference symbol 58 denotes feed rollers respectively arranged on the lower right side of the bleaching lamp 55C, with each outer peripheral face being abutted against the color heat sensitive paper 40, for guiding the heat sensitive paper 40 in the direction of the arrow Z shown in the figure. Reference symbol 59 denotes a cutter arranged on the right side of the feed rollers 58, which cuts the end portion of the color heat sensitive paper 40 to a certain length. Reference symbol 60 denotes a storage case arranged on the right side of the cutter 59, for piling up and storing the color heat sensitive papers 40*a* cut by the cutter 59.

The operation of the color printer described above will now be described. At first, in FIG. 28, when power is supplied to each section of the apparatus, the feed rollers 42 are rotated and driven by a motor (not shown). As a result, the color heat sensitive paper 40 is transported in the direction of the arrow Z shown in this figure, while being clamped between the roll-out feed rollers 42. When the end portion of the color heat sensitive paper 40 comes to above the platen roller 43, the roll-out feed rollers 42 are stopped, and the thermal head 44Y is pressed against the platen roller 43 with the color heat sensitive paper 40 being clamped therebetween. That is, the color heat sensitive paper 40 is in a state where the first line thereof is pressed by the platen roller 43 against the first exothermic resistors 1905 of the yellow thermal head 44Y shown in FIG. 28.

Figure 27A:
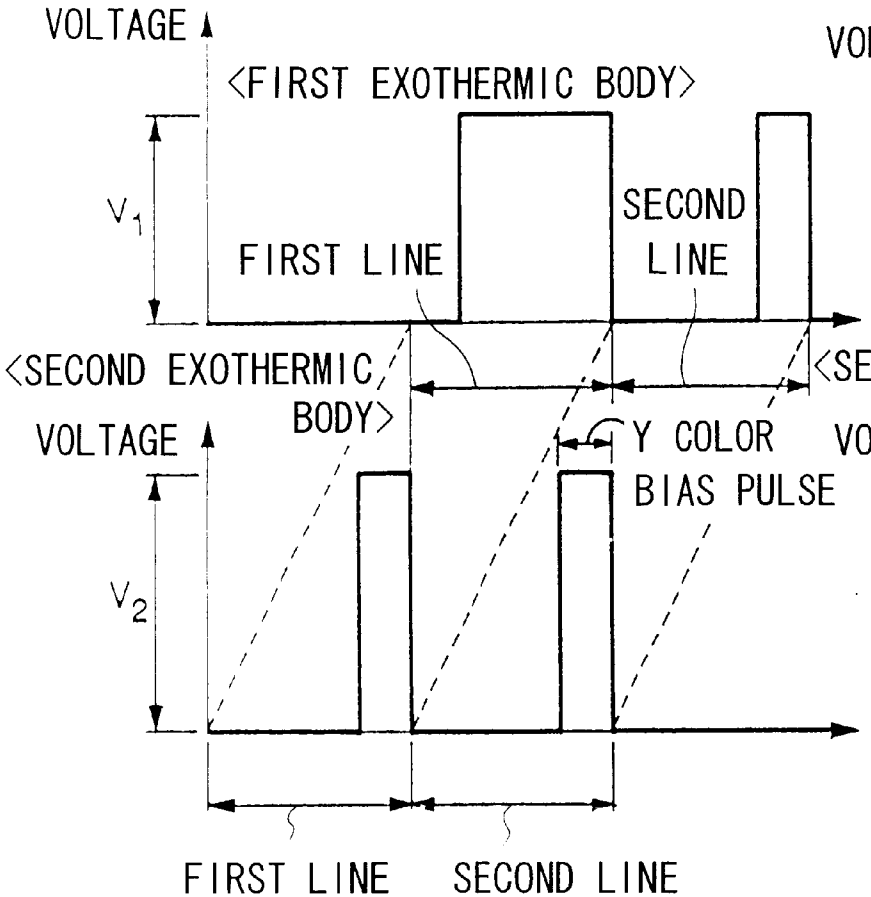
FIGS. 27A and 27B are graphs showing supply voltage in one embodiment of a printing method according to the present invention.
Figure 28:
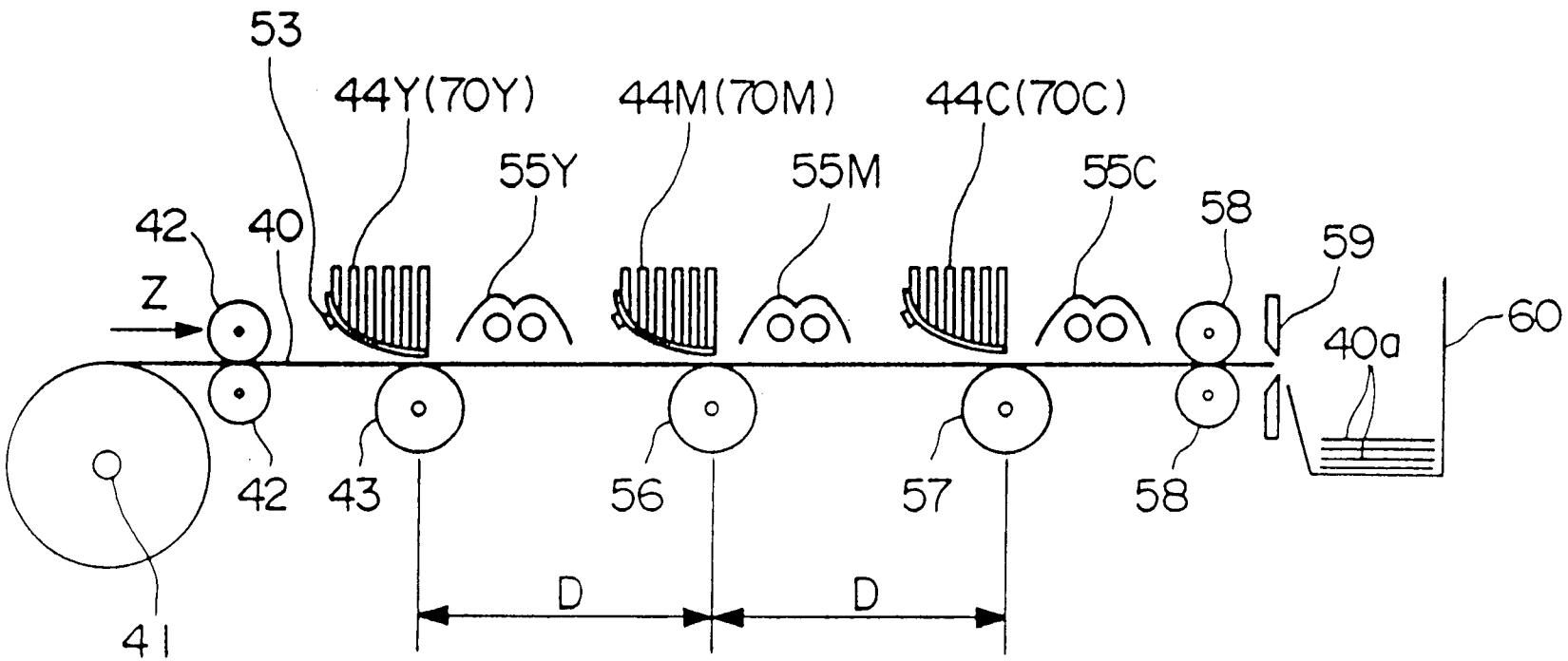
FIG. 28 is a schematic diagram of an apparatus used in one embodiment of a printing method according to the present invention.

Then, as shown in FIG. 27A, energy immediately before developing the yellow color is provided with respect to the yellow recording layer of the color heat sensitive paper 40 to perform the preheating operation, by applying a Y color bias pulse to the first exothermic bodies. That is to say, the control section supplies a switching control signal for a certain period of time to a base terminal of a switching transistor 1052. As a result, the switching transistor 1052 is turned ON for a certain period of time, and at the same time, the above described preheating voltage is respectively applied to the first exothermic resistors 1905 to generate Joule heat.

As a result, energy on the yellow recording layer of the heat sensitive paper 40 increases with the lapse of time, and the above described energy immediately before the energy for starting development of the yellow color is applied thereto. After a certain period of time has passed, the control section suspends supply of the switching control signal with respect to the base terminal of the switching transistor 1952.

Then, the platen roller 43 is rotated and driven through an angle corresponding to one line, to thereby transport the color heat sensitive paper 40 for one line in the direction of the arrow Z shown in FIG. 28. Hence, the first line on the color heat sensitive paper 40, that is, a portion where the energy immediately before the energy for starting development of the yellow color is applied, is positioned in close proximity to the second exothermic resistors 1904 shown in FIG. 24. At the same time, the second line of the color heat sensitive paper 40 is positioned in close proximity to the first exothermic resistors 1905. Here, the width of the common electrode 1912 shown in FIG. 24 is not taken into consideration, in order to simplify the description.

The control section then supplies a switching control signal for a certain period of time to the first exothermic bodies in FIG. 27A with respect to the base terminal of the switching transistor 1952 shown in FIG. 24. As a result, bias energy is applied to the second line of the color heat sensitive paper 40, to thereby perform the above described preheating operation, and the energy for the second line is made to be a value immediately before the energy for staring development of the yellow color.

Figure 27B:
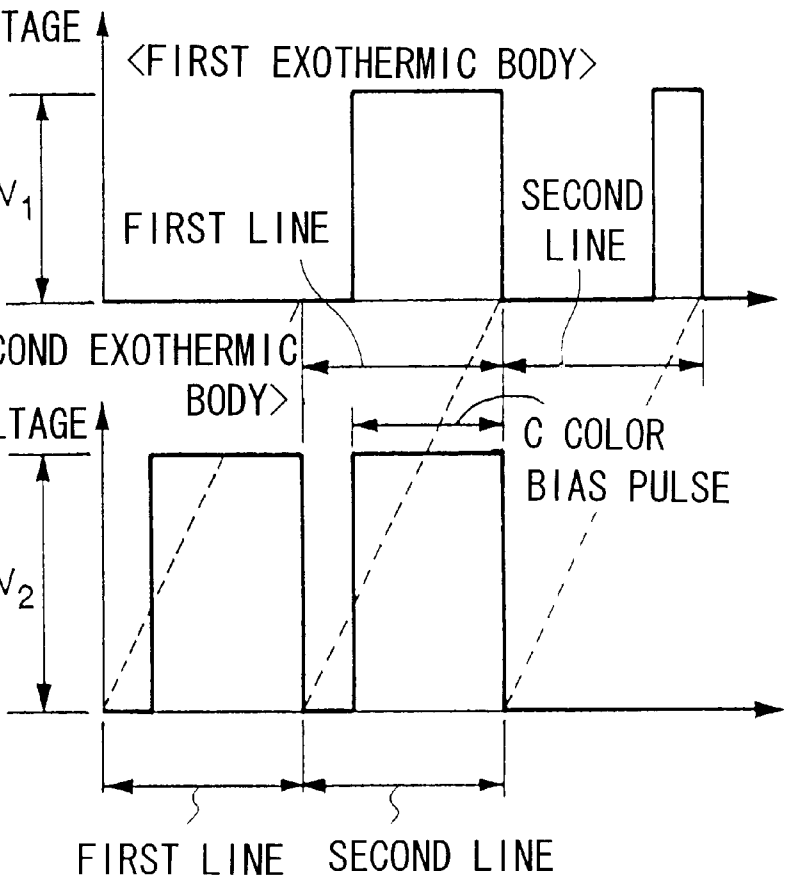

Moreover, in parallel with the above described preheating operation, the printing operation of the yellow color is performed by adding a pulse signal for the first line in FIGS. 27A and 27B to the second exothermic bodies, with respect to the first line of the color heat sensitive paper 40. That is to say, the control IC 1950 reads the yellow color printing data for the first line regarding the yellow color supplied from the control section. Then, if it is assumed that the above described yellow color printing data is data instructing to print the yellow color of, for example, 180 gradations, the control IC 1950 performs a switching operation for making conducting the concerned second exothermic resistor 1904 of the second exothermic resistors 1904 and the second DC power source (not shown). As a result, the concerned second exothermic resistor 1904 is subjected to a gradation voltage for the time corresponding to the yellow color printing data, to thereby generate Joule heat.

The energy on the yellow recording layer for the first line of the color heat sensitive paper 40 gradually increases due to the Joule heat, to more than the energy for starting development of yellow color. As a result, the yellow color is developed on the yellow recording layer. Then, with the lapse of time, since the energy on the yellow recording layer increases, the gradient of the yellow color increases.

Then, the feed rollers 58 shown in FIG. 28 are rotated and driven through an angle corresponding to one line. Thereby, the above described second line of the color heat sensitive paper 40 is positioned in close proximity to the second exothermic resistors 1904, and at the same time, the third line of the color heat sensitive paper 40 is positioned in close proximity to the first exothermic resistors 1905. Then, in the same manner as described above, the preheating operation with respect to the third line of the color heat sensitive paper 40 and the yellow printing operation with respect to the second line of the color heat sensitive paper 40 are performed.

With the progress of printing of the yellow color as described above, when the end portion of the color heat sensitive paper 40, shown in FIG. 28, that is, the portion where the yellow color is developed, is transported to directly under the yellow color fixing lamp 55Y, light generated by the yellow color fixing lamp 55Y is irradiated onto the color heat sensitive paper 40. As a result, fixation of the yellow color is effected.

With the further progress of printing of the yellow color, when the end portion of the color heat sensitive paper 40 is clamped between the magenta thermal head 44M and the platen roller 56, the printing operation of the magenta color is performed in the same manner as the printing operation of the yellow color with the above described yellow thermal head 44Y. That is to say, in the printing operation of the magenta color, after the preheating operation is performed with respect to the first line of the color heat sensitive paper 40, the operation for actually printing the magenta color for the first line is performed, while the preheating operation for the second line is performed in parallel.

At the time of the above described preheating operation, a preheating pulse voltage having a pulse width corresponding to the energy immediately before the energy for starting development of the magenta color described above is simultaneously applied to the first exothermic resistors 1905 shown in FIG. 24. As a result, the energy immediately before the energy for starting development of the magenta color is applied to the magenta recording layer of the color heat sensitive paper shown in FIG. 28.

At the time of the operation for actually printing the magenta color, a gradation voltage having a pulse width corresponding to the gradient specified by the magenta color printing data is applied to the concerned second exothermic resistor 1904 of the second exothermic resistors 1904 shown in FIG. 24. As a result, the magenta color is developed on the magenta recording layer. When the end portion of the color heat sensitive paper 40 shown in FIG. 28, that is the portion where the magenta color has been developed, is positioned directly under the magenta color fixing lamp 55M, the magenta color is fixed on the magenta recording layer of the color-heat sensitive paper 40.

With the progress of printing of the yellow color and the magenta color as described above, when the end portion of the color heat sensitive paper 40 shown in FIG. 28 is clamped between the cyan thermal head 44C and the platen roller 57, the printing operation of the cyan color is performed with respect to the color heat sensitive paper 40.

That is to say, as shown in FIG. 27B, after the first line of the color heat sensitive paper 40 is positioned in close proximity to the first exothermic resistors 1905 shown in FIG. 24, a preheating voltage is simultaneously applied to the first exothermic resistors 1905 for a certain period of time. The pulse width of this preheating voltage corresponds to the energy for starting development of the cyan color described above.

Accordingly, the Joule heat generated in the first exothermic resistors 1905 is shifted to the first line of the color heat sensitive paper 40, and as a result, the energy immediately before the energy for starting development of the cyan color, is applied to the first line.

The above first line of the color heat sensitive paper 40 is moved close to the second exothermic resistors 1904 from close proximity to the first exothermic resistors 1905 shown in FIG. 24, and at the same time, the second line of the color heat sensitive paper 40 is positioned in close proximity to the first exothermic resistors 1905.

A gradation pulse voltage corresponding to, for example, 180 gradations is applied to the second exothermic resistors 1904 for a certain period of time. By so doing, Joule heat having the cyan gradation energy corresponding to the gradation pulse voltage is generated in the second exothermic resistors 1904. As a result, the cyan color having 180 gradations is developed on the cyan recording layer of the color heat sensitive paper 40 shown in FIG. 20.

Simultaneously with the cyan color printing, a preheating pulse voltage is applied to the first exothermic resistors 1905 shown in FIG. 20 for a certain period of time. Thereby, the energy immediately before the energy for starting development of the cyan color is applied to the second line of the color heat sensitive paper 40, in the same manner as described above.

Thereafter, in the same manner as described above, the cyan printing operation for the second line of the color heat sensitive paper 40 and the preheating operation for the third line onward are performed.

With the progress of printing of the yellow color, magenta color and cyan color, when the end portion of the color heat sensitive paper 40 shown in FIG. 28 is positioned directly under the bleaching lamp 55C, bleaching with respect to the unprinted portion of the above described color heat sensitive paper 40 is effected.

Then, the end portion of the color heat sensitive paper 40 is transported towards the cutter 59 by means of the feed rollers 58, and the end portion for a certain length of the color heat sensitive paper 40 is cut by the cutter 59, and stored in the storage case 30.

As described above, according to the color printer in the first embodiment of the present invention, since the surfaces of the yellow thermal head 44Y, the magenta thermal head 44M and the cyan thermal head 44C shown in FIG. 28 are formed in a curved face, the transport route of the color heat sensitive paper 40 can be made straight.

Therefore, according to the color printer in the first embodiment, since uneven transport of the color heat sensitive paper 40 does not occur, lateral stripes or resist deviation does not occur in the heat sensitive paper 40. As a result the effect can be obtained in that high-quality color printing is possible.

Figure 11:
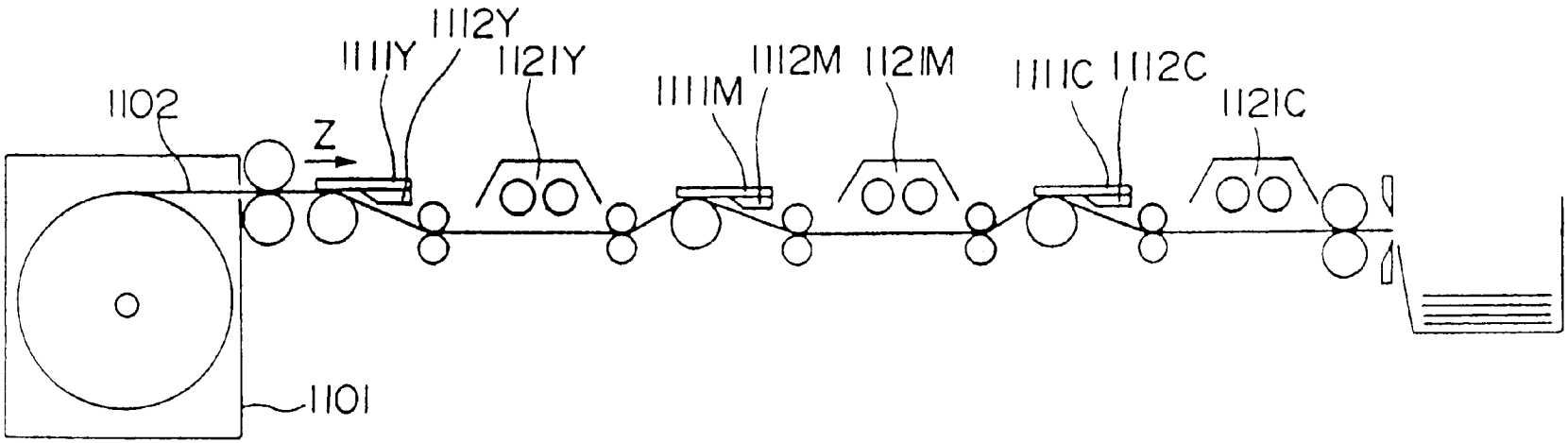
FIG. 11 is schematic view of a conventional other thermal printer.

Moreover, according to the color printer in the first embodiment, since it is not necessary to bend the transport route of the color heat sensitive paper 40 in a complicated shape as shown in FIG. 11, parts such as guide rollers 20, 24 shown in FIG. 11 are not required. Therefore, according to the color printer in the above described first embodiment, the mechanism can be made simple compared to the conventional color printer, thereby enabling cost reduction.

Also, according to the color printer in the first embodiment described above, since the preheating operation for the second line to be printed next is performed, in parallel with the printing operation for the preheated first line, with respect to the color heat sensitive paper 40, the effect can be obtained in that the printing time can be shortened compared to the conventional printer.

In addition, according to the color printer in the first embodiment described above, since each distance D between the platen rollers 43, 56 and 57 is made the same as or shorter than the print length of the color heat sensitive paper 40*a*, the effect can be obtained in that head up and head down of each yellow thermal head 44Y, magenta thermal head 44M and cyan thermal head 44C can be performed synchronously.

Various embodiments have been described above, but the present invention is not limited to these embodiments, and combinations of parts of each embodiment with parts of other embodiment are also included in the present invention.

INDUSTRIAL APPLICABILITY

The thermal head of the present invention is a thermal head which generates heat by supplying drive current to the exothermic resistors based on the printing data, to thereby perform dot printing, and comprises a substrate, an insulating layer which is disposed covering the substrate, with a part of the surface thereof being formed by raising up, and an exothermic resistor pattern formed on the surface of the raised portion of the insulating layer. The substrate has a common electrode protruding from the surface of the substrate, passing through the raised portion of the insulating layer and being exposed from the surface of the insulating layer and connected to the exothermic resistor pattern, which divides the exothermic resistor pattern into a first exothermic resistor and a second exothermic resistor, centering on the connecting point. Hence, after the heat energy generated by the first exothermic resistor is applied to the heat sensitive paper, the heat energy generated by the second exothermic resistor can be applied to the heat sensitive paper at the time of printing. Hence the energizing pulse to each exothermic resistor required for color development can be made short, enabling reduction of the printing time.

What is claimed is:

1. A thermal head substrate comprising:

an exothermic resistor section in which exothermic resistors are provided;

an IC mounting section on which an IC is to be mounted so as to energize the exothermic resistors; and a wiring section in which wiring connecting the exothermic resistor section and the IC mounting section is arranged;

wherein a thickness of at least a part of the wiring section is smaller than that of the exothermic resistor section and the IC mounting section.

2. A thermal head substrate according to claim 1, comprising one or two or more of the wiring sections, and a thin portion is respectively formed in each wiring section.

3. A thermal head comprising:

a substrate;

an insulating layer which is disposed on the substrate and having a raised portion being formed by raising a part of the surface thereof; and exothermic resistors formed on the raised portion;

wherein a common electrode is disposed on the substrate so as to protrude from the surface of the substrate, the common electrode penetrates through the raised portion and is connected to the exothermic resistors, and the exothermic resistors are divided into first exothermic resistors and second exothermic resistors at a connecting point of the common electrode.

4. A thermal head according to claim 3, wherein a portion surrounded by the first exothermic resistors and the common electrode, and a portion surrounded by the second exothermic resistors and the common electrode, of the raised portion, are formed of a heat reserve material.

5. A thermal head according to claim 3, wherein the substrate is a metal substrate, and the metal substrate and the common electrode are integrally formed and hence have the same electric potential, and the metal substrate has a function as an electrode.

6. A thermal head according to claim 3, wherein the width of the common electrode is 2 mm or less.

7. A thermal head according to claim 3, wherein leads of the first and second exothermic resistors are connected to a control IC which controls the energization thereof.

8. A thermal head according to claim 3, wherein the first exothermic resistors and the second exothermic resistors are linearly arranged with equal spacing to each other, and the first exothermic resistors and the second exothermic resistors are shifted by a distance of ½ of the spacing along the arrangement direction.

9. A thermal head according to claim 7, wherein the second exothermic resistors are connected to the control IC via the leads, while the first exothermic resistors are respectively connected to a plurality of transistors via the leads, put together in a plurality of blocks, and the first exothermic resistors are arranged ahead of the second exothermic resistors with respect to the paper feed direction at the time of printing.

10. A thermal head according to claim 3, where comprising a heat sink having a surface formed in a curved shape, wherein at least a screw hole is formed on the surface of the heat sink, the substrate has at least a hole formed therein whose diameter is larger than the screw hole, and at least a screw is penetrated through the hole and screwed into the screw hole for fitting the substrate along the upper face of the heat sink.

11. A thermal head according to claim 10, wherein the hole is a slot having a longer opening diameter in the longitudinal direction of the electrode section.

12. A printing method for developing color on a printing paper using the thermal head according to claim 3, comprising:

moving a printing paper so as to contact the first and second exothermic resistors of the thermal head while maintaining the printing paper straight between the first and second exothermic resistors;

applying bias energy required at least for color development of the printing paper by the first exothermic resistors; and applying energy applied by the second exothermic resistors to a portion to be printed in the preheated portion to which the bias energy has been applied, to thereby develop color on the printing paper in a desired gradation concentration.

13. A printing method according to claim 12, comprising a step of correcting the bias energy generated by the first exothermic bodies by means of a drive circuit, depending on the service condition of the printer, wherein the correction of bias energy is performed based on at least one of the ambient temperature of the printer or line history.

14. A color printer comprising:

a heat sensitive paper on which a first coupler that develops a first color upon application of energy larger than a first color development energy, a second coupler that develops a second color upon application of energy larger than a second color development energy, and a third coloring material that develops a third color upon application of energy larger than a third color development energy are coated;

a transport device which transports the heat sensitive paper in line units; and a thermal head according to claim 7;

wherein the surface of the thermal head is formed in a curved shape, and the thermal head is provided in the middle of a straight transport passage of the heat sensitive paper.

* * * * *